US005154997A

United States Patent [19]

Kato et al.

[11] Patent Number: 5,154,997

[45] Date of Patent: Oct. 13, 1992

[54] ELECTROPHOTOGRAPHIC LIGHT-SENSITIVE MATERIAL

[75] Inventors: Eiichi Kato; Seishi Kasai; Kazuo Ishii, all of Shizuoka, Japan

[73] Assignee: Fuji Photo Film Co., Ltd., Kanagawa, Japan

[21] Appl. No.: 661,150

[22] Filed: Feb. 27, 1991

[30] Foreign Application Priority Data

Feb. 28, 1990 [JP] Japan ..... 2-45833

[51] Int. Cl.[5] ..... G03G 5/00; G03G 15/02

[52] U.S. Cl. ..... 430/96; 430/58

[58] Field of Search ..... 430/96, 58

[56] References Cited

U.S. PATENT DOCUMENTS 4,871,638 10/1989 Kato et al. ..... 430/96
4,952,475 8/1990 Kato et al. .
4,968,572 11/1990 Kato et al. ..... 430/96
5,009,975 4/1991 Kato et al. ..... 430/96
5,030,534 7/1991 Kato et al. ..... 430/96

*Primary Examiner*—Marion E. McCamish
*Assistant Examiner*—S. Crossan
*Attorney, Agent, or Firm*—Sughrue, Mion, Zinn, Macpeak & Seas

[57] ABSTRACT

An electrophotographic light-sensitive material is disclosed. The light-sensitive material comprises a support having provided thereon a photoconductive layer containing at least one inorganic photoconductive substance, a spectral sensitizer, and a binder resin which contains at least one binder resin (A) and at least one binder resin (B) as defined in the specification. The light-sensitive material is excellent in electrostatic charging characteristics and pre-exposure fatigue resistance.

11 Claims, No Drawings

ELECTROPHOTOGRAPHIC LIGHT-SENSITIVE MATERIAL

FIELD OF THE INVENTION

The present invention relates to an electrophotographic light-sensitive material, and more particularly to an electrophotographic light-sensitive material which is excellent in electrostatic charging characteristics and pre-exposure fatigue resistance.

BACKGROUND OF THE INVENTION

An electrophotographic light-sensitive material may have various structures depending upon the characteristics required or an electrophotographic process being employed.

An electrophotographic system in which the light-sensitive material comprises a support having thereon at least one photoconductive layer and, if necessary, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if necessary, transfer.

Furthermore, a process of using an electrophotographic light-sensitive material as an offset master plate for direct plate making is widely practiced.

Binders which are used for forming the photoconductive layer of an electrophotographic light-sensitive material are required to be excellent in the film-forming property by themselves and the capability of dispersing a photoconductive powder therein. Also, the photoconductive layer formed using the binder is required to have satisfactory adhesion to a base material or support. Further, the photoconductive layer formed by using the binder is required to have various excellent electrostatic characteristics such as high charging capacity, small dark decay, large light decay, and less fatigue due to pre-exposure and also have an excellent image forming properties, and the photoconductive layer stably maintaining these electrostatic properties in spite of the change of humidity at the time of image formation.

Binder resins which have been conventionally used include silicone resins (e.g., JP-B-34-6670, the term "JP-B" as used herein means an "examined published Japanese patent application"), styrene-butadiene resins (e.g., JP-B-35-1960), alkyd resins, maleic acid resins, polyamides (e.g., JP-B-35-11219), polyvinyl acetate resins (e.g., JP-B-41-2425), vinyl acetate copolymers (e.g., JP-B-41-2426), acrylic resins (JP-B-35-11216), acrylic acid ester copolymers (e.g., JP-B-35-11219, JP-B-36-8510, and JP-B-41-13946), etc.

However, in the electrophotographic light-sensitive materials using these binder resins, there are various problems such as 1) the affinity of the binder with a photoconductive powder is poor thereby reducing the dispersibility of the coating composition containing them, 2) the charging property of the photoconductive layer containing the binder is low, 3) the quality (in particular, the dot image reproducibility and resolving power) of the image portions of duplicated images is poor, 4) the image quality is liable to be influenced by the environmental conditions (e.g., high temperature and high humidity or low temperature and low humidity) at the time of the formation of the duplicated image, and 5) the photoconductive layer is insufficient in film strength and adhesion, which causes, when the light-sensitive material is used for an offset master, peeling off of the photoconductive layer, etc. at offset printing to reduce the number of prints.

In order to improve electrostatic characteristics of the photoconductive layer, various attempts have hitherto been made. For example, incorporation of a compound having an aromatic ring or a furan ring containing a carboxy group or a nitro group either alone or in combination with a dicarboxylic anhydride in a photoconductive layer is disclosed in JP-B-42-6878 and JP-B-45-3073. However, the thus improved electrophotographic light-sensitive materials are yet insufficient in electrostatic characteristics and, in particular, light-sensitive materials having excellent light decay characteristics have not yet been obtained. Thus, for compensating the insufficient sensitivity of these light-sensitive materials, an attempt has been made to incorporate a large amount of a sensitizing dye into the photoconductive layer. However, light-sensitive materials containing a large amount of a sensitizing dye undergo considerable deterioration of whiteness to reduce the quality as a recording medium, sometimes causing deterioration in dark decay characteristics, whereby satisfactory reproduced images are not obtained.

On the other hand, JP-A-60-10254 (the term "JP-A" as used herein means an "unexamined published Japanese patent application") discloses a method of using a binder resin for a photoconductive layer by controlling the average molecular weight of the resin. That is, JP-A-60-10254 discloses a technique for improving the electrostatic characteristics (in particular, reproducibility at repeated use as a PPC light-sensitive material), moisture resistance, etc., of the photoconductive layer by using an acrylic resin having an acid value of from 4 to 50 and an average molecular weight of from $1\times10^3$ to $1\times10^4$ and an acrylic resin having an acid value of from 4 to 50 and an average molecular weight of from $1\times10^4$ to $2\times10^5$ in combination.

Furthermore, lithographic printing plate precursors using electrophotographic light-sensitive materials have been extensively investigated and various binder resins for a photoconductive layer have been prepared as satisfying both the electrostatic characteristics as an electrophotographic light-sensitive material and the printing characteristics as a printing plate precursor. For example, JP-B-50-31011 discloses a combination of a resin having a molecular weight of from $1.8\times10^4$ to $10\times10^4$ and a glass transition point (Tg) of from 10° to 80° C. obtained by copolymerizing a (meth)acrylate monomer and other monomers in the presence of fumaric acid and a copolymer composed of a (meth)acrylate monomer and a copolymerizable monomer other than fumaric acid, JP-A-53-54027 discloses a terpolymer containing a (meth)acrylic acid ester unit with a substituent having a carboxylic acid group at least 7 atoms apart from the ester linkage, JP-A-54-20735 and JP-A-57-202544 disclose a tetra- or pentapolymer containing an acrylic acid unit and a hydroxyethyl (meth)acrylate unit, and JP-A-58-68046 discloses a terpolymer containing a (meth)acrylic ester unit with an alkyl group having from 6 to 12 carbon atoms as a substituent and a vinyl monomer containing a carboxyl group as effective for improving the oil-desensitization of the photoconductive layer.

However, none of these resins proposed have proved to be satisfactory for practical use in charging property, dark charge retention characteristic, photosensitivity, and smoothness of the photoconductive layer.

Also, as the result of evaluations on the conventional binder resins which are said to be developed for electrophotographic lithographic printing plate precursors, it has been found that they have problems in the above-described electrostatic characteristics, background stains of prints, etc.

For solving these problems, JP-A-63-217354 discloses that the smoothness and the electrostatic characteristics of a photoconductive layer can be improved and images having no background stains are obtained by using a low-molecular weight resin (molecular weight of from 1,000 to 10,000) containing from 0.05 to 10% by weight of a copolymerizable component having an acidic group in the side chain of the copolymer as the binder resin, JP-A-1-100554 discloses a binder further containing a curable group-containing copolymerizable component together with the above-described acidic group-containing copolymerizable component, JP-A-1-102573 discloses a binder resin using crosslinking agent together with the above-described acidic group-containing resin, JP-A-63-220149, JP-A-63-220148, and JP-A-64-564 disclose a binder resin using a high molecular weight resin having a weight average molecular weight of at least $1\times10^{\infty}$ in combination with the above-described acidic group-containing resin, and JP-A-1-102573 discloses a binder resin using a heat- and/or photo-curable resin in combination with the above-described acidic group-containing resin.

On the other hand, as other binder resins for electrophotographic light-sensitive materials for solving the above-described problems, JP-A-1-70761 discloses a binder resin using a resin having a weight average molecular weight of from $1\times10^3$ to $1\times10^4$ having an acidic group at the terminal of the polymer main chain, JP-A-1-214865 discloses a binder resin using the above-described resin further containing a curable group-containing component as a copolymerizable component, JP-A-2-874 discloses a binder using a cross-linking agent together with the above-described resin, JP-A-1-280761, JP-A-1-116643, and JP-A-1-169455 disclose a binder resin using a high molecular weight resin having a weight average molecular weight of at least $1\times10^4$ in combination with the above-described resin, and JP-A-2-34859 discloses a binder resin using a heat- and photo-curable resin in combination with the above-described resin.

However, it has been found that these resins still have problems in maintenance of the stable high performance when the electrophotographic light-sensitive materials are exposed to noticeably severe conditions.

More specifically, it has been found that, when a charging speed is increased in a charging step of the light-sensitive material, uneven charging occurs, which results in causing unevenness in the duplicated images, or, when a duplicating operation is carried out directly after irradiating the surface of the electrophotographic light-sensitive material with a fluorescent lamp, etc., as a supplemental operation for a copying machine, the duplicated images obtained are deteriorated (in particular, lowering of the image density, lowering of the resolving power, and the occurrence of background fog) (so-called pre-exposure fatigue).

Furthermore, when the electrophotographic light-sensitive material described above is used as lithographic printing plate precursor by an electrophotographic system, the printing plate has the duplicated images having deteriorated image quality in the case of carrying out the duplication under the above-described condition, and, when printing is conducted using the plate, serious problems may occur such as lowering of image quality and the occurrence of background fog.

SUMMARY OF THE INVENTION

The present invention has been made for solving the above described problems of conventional electrophotographic light-sensitive materials.

An object of the present invention is, therefore, to provide a CPC electrophotographic light-sensitive material having improved charging characteristics and pre-exposure fatigue resistance.

Another object of the present invention is to provide a lithographic printing plate precursor by an electrophotographic system capable of providing a number of prints having clear images.

It has now been found that the above-described objects are accomplished by an electrophotographic light-sensitive material comprising a support having provided thereon a photoconductive layer containing at least an inorganic photoconductive substance, a spectral sensitizer, and a binder resin, wherein said binder resin contains at least one binder resin (A) described below and at least one binder resin (B):

Binder Resin (A):

a resin having a weight average molecular weight of from $1\times10^3$ to $1\times10^4$, containing at least 30% by weight of a polymer component represented by formula (I) shown below and from 0.1 to 10% by weight of a polymer component containing at least one acidic group selected from $-PO_3H_2$, $-SO_3H$, $-COOH$,

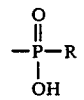

(wherein R represents a hydrocarbon group or —OR' (wherein R' represents a hydrocarbon group) and a cyclic acid anhydride-containing group, and having at least one acidic group selected from the above-described acidic groups at one terminal of the main chain of the copolymer;

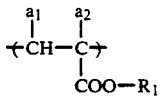

(I)

wherein $a_1$ and $a_2$ each represent a hydrogen atom, a halogen atom, a cyano group or a hydrocarbon group, and $R_1$ represents hydrocarbon group;

Binder Resin (B):

a resin having a weight average molecular weight of from $3\times10^4$ to $1\times10^6$ and containing at least 30% by weight of a polymer component represented by following formula (III);

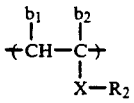

(III)

wherein X represents $(CH_2)_nCOO-$, $-(CH_2)_mOCO-$, —O— or

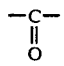

(wherein n and m each represents an integer of from 0 to 3); and $b_1$, $b_2$, and $R_2$ have the same meaning as $a_1$, $a_2$, and $R_1$, respectively, in formula (I).

DETAILED DESCRIPTION OF THE INVENTION

The binder resin which can be used in the present invention comprises at least a low molecular weight resin (A) containing a polymer component having the specific repeating unit and a polymer component having the specific acidic group (hereinafter, the term "acidic group" used in the present invention includes a cyclic acid anhydride-containing group, unless otherwise indicated) and having an acidic group at one terminal of the polymer main chain and a middle to high molecular weight resin (B) containing at least the repeating unit shown by formula (III).

As described above, it is known that a resin containing an acidic group-containing polymer component and a resin having an acidic group at the terminal of the main chain thereof are known as a binder resin for an electrophotographic light-sensitive material, but, as shown in the present invention, it has been surprisingly found that the above-described problems in conventional techniques can be first solved by using the resin having not only an acidic group-containing polymer component, but having an acidic group also at the terminal of the polymer main chain.

According to a preferred embodiment of the present invention, the low molecular weight resin (A) is a low molecular weight resin having the acidic group at the terminal and containing the acidic group-containing component and a methacrylate component having a specific substituent containing a benzene ring or a naphthalene ring (hereinafter referred to as resin (A')) represented by the following general formula (IIa) or (IIb):

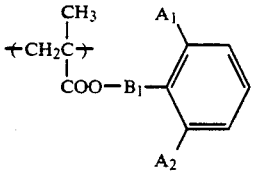

(IIa)

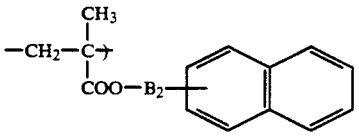

(IIb)

wherein $A_1$ and $A_2$ each represents a hydrogen atom, a hydrocarbon group having from 1 to 10 carbon atoms, a chlorine atom, a bromine atom, $—COD_1$ or $—COOD_2$, wherein $D_1$ and $D_2$ each represents a hydrocarbon group having from 1 to 10 carbon atoms; and $B_1$ and $B_2$ represents a mere bond or a linking group containing from 1 to 4 linking atoms, which connects —COO— and the benzene ring.

Furthermore, in a preferred embodiment, the middle to high molecular weight resin (B) is preferably a polymer further having at least one acidic group selected from $—PO_3H_2$, $—SO_3H$, —COOH,

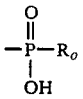

(wherein $R_o$ has the same meaning as R described above) and a cyclic acid anhydride-containing group (hereinafter, the polymer is referred to as resin (B')).

In the present invention, it has been found that, in the dispersion system existing at least an inorganic photoconductive substance and a spectral sensitizer, the low molecular weight resin (A) effectively adsorbs onto the stoichiometric defects of the photoconductive substance without hindering the adsorption of the spectral sensitizer onto the inorganic photoconductive substance, adequately improves the coating property on the surface of the photoconductive substance, compensates the traps of the photoconductive substance, compensates for the sensitivity increasing effect of the photoconductive substance with the spectral sensitizer, greatly improves the moisture resistance, and further sufficiently disperses the photoconductive particles to inhibit the occurrence of aggregation of the photoconductive substance.

Also, the resin (B) sufficiently heightens the mechanical strength of the photoconductive layer which may be insufficient in case of using the resin (A) alone, without damaging the excellent electrophotographic characteristics attained by the use of the resin (A).

It is believed that, by specifying the weight average molecular weight of each of the resin (A) and the resin (B) and the contents and the bonding positions of the acidic groups in the resins as the binder resin for the inorganic photoconductive substance according to the present invention, the strength of the interaction of the inorganic photoconductive substance, the spectral sensitizer, and the resins can be properly changed in the dispersed state of these components and the dispersion state can be stably maintained.

Thus, it is believed that, for the reasons described above, the charging characteristics are improved, uneven charging does not occur, and the pre-exposure fatigue resistance is improved.

In case of using the resin (A'), the electrophotographic characteristics, particularly, $V_{10}$, DRR and $E_{1/10}$ of the electrophotographic material can be furthermore improved as compared with the use of the resin (A). While the reason for this fact is not fully clear, it is believed that the polymer molecular chain of the resin (A') is suitably arranged on the surface of inorganic photoconductive substance such as zinc oxide in the layer depending on the plane effect of the benzene ring or the naphthalene ring which is an ester component of the methacrylate whereby the above described improvement is achieved.

Further, when the resin (B') is employed, the electrostatic characteristics, particularly, DRR and $E_{1/10}$ of the electrophotographic material are further improved without damaging the excellent characteristics due to the resin (A), and these preferred characteristics are almost maintained in the case of greatly changing the environmental conditions from high temperature and high humidity to low temperature and low humidity.

Also, in the present invention, the smoothness of surface of the photoconductive layer can be improved. When an electrophotographic light-sensitive material having a photoconductive layer of rough surface is used as a lithographic printing plate precursor by an electrophotographic system, since the dispersion state of inorganic particles as a photoconductive substance and a binder resin is not proper and the photoconductive layer is formed in a state of existing aggregates, whereby when the photoconductive layer is subjected to an oil-desensitizing treatment with an oil-desensitizing solution, the non-image areas are not uniformly and sufficiently rendered hydrophilic to cause attaching of a printing ink at printing, which results in causing background stains at the non-image portions of the prints obtained.

In the case of using the binder resin according to the present invention, the interaction of the adsorption and coating of the inorganic photoconductive substance and the binder resin is adequately performed, and the film strength of the photoconductive layer is maintained.

Moreover, since the deterioration of the image quality and the formation of the background fog caused by uneven charging or pre-exposure fatigue do not occur, prints having very excellent images can be obtained when the electrophotographic light-sensitive material of the present invention is used as a lithographic printing plate precursor.

In the resin (A), the weight average molecular weight is from $1\times10^3$ to $1\times10^4$, and preferably from $3\times10^3$ to $8\times10^3$, the content of the copolymer component corresponding to the repeating unit represented by formula (I) is at least 30% by weight, and preferably from 50 to 97% by weight. The total content of the acidic groups in the acidic group-containing copolymer component and the acidic group bonded to the terminal of the main chain is preferably from 1 to 20% by weight. Furthermore, the content of the copolymer component containing the acidic group is preferably from 0.1 to 10% by weight, and more preferably from 0.5 to 8% by weight, and the content of the acidic group bonded to the terminal of the main chain is preferably from 0.5 to 15% by weight, and more preferably from 1 to 10% by weight.

Also, the content of the copolymer component of the methacrylate corresponding to the repeating unit represented by formula (IIa) and/or formula (IIb) in the resin (A') is at least 30% by weight, and preferably from 50 to 97% by weight, and the content of the copolymer component containing the acidic group is preferably from 0.1 to 10% by weight, and more preferably from 0.5 to 8% by weight. Also, the content of the acidic group bonded to the terminal of the polymer chain is preferably from 0.5 to 15% by weight, and more preferably from 1 to 10% by weight.

The glass transition point of the resin (A) is preferably from −20° C. to 110° C., and more preferably from −10° C. to 90° C.

On the other hand, the weight average molecular weight of the resin (B) is from $3\times10^4$ to $1\times10^6$, and more preferably from $5\times10^4$ to $5\times10^5$.

Also, the content of the copolymer component corresponding to the repeating unit of formula (III) is at least 30% by weight, and preferably at least 50% by weight.

Furthermore, the resin (B) may further contain an acidic group-containing component as a copolymer component and, when the resin (B) contains the acidic group-containing copolymer component, the content thereof is not more than 10% by weight, and more preferably not more than 5% by weight.

Also, in the resin (B'), the content of the acidic group bonded to the terminal of the main chain is preferably from 0.1 to 5% by weight.

Also, when the resin (B) contains the copolymer component containing the acidic group and the acidic group at the terminal of the main chain thereof, the total content of the acidic groups is preferably from 0.5 to 10% by weight, and more preferably from 0.5 to 5% by weight.

The glass transition point of the resin (B) is preferably from 0° C. to 110° C., and more preferably from 20° C. to 90° C.

If the molecular weight of the binder resin (A) is less than $1\times10^3$, the film-forming property thereof is reduced, and a sufficient film strength cannot be maintained. On the other hand, if the molecular weight of the binder resin (A) is higher than $1\times10^4$, the deviation of the electrophotographic characteristics (charging property and pre-exposure fatigue resistance) under the above-described severe condition changes somewhat largely, and the effect of the present invention for obtaining stable duplicated images is reduced.

If the total content of the acidic groups in the binder resin (A) is less than 1% by weight, the initial potential is low and a sufficient image density cannot be obtained. On the other hand, if the total acidic group content is larger than 20% by weight, the dispersibility is reduced even if the molecular weight of the binder resin (A) is low, the smoothness of the layer and the electrophotographic characteristics at high humidity are reduced, and further, when the light-sensitive material is used as an offset master plate, the occurrence of background stains is increased.

Also, if the molecular weight of the binder resin (B) is less than $3\times10^4$, the film strength becomes insufficient. On the other hand, if the molecular weight thereof is larger than $1\times10^6$, the dispersibility is reduced, the smoothness of the layer is reduced, and the image quality of the duplicated images is reduced (in particular, the reproducibility of fine lines and letters is reduced). Further, when the light-sensitive material is used as an offset master, the occurrence of background stains becomes severe.

Now, the resin (A) and the resin (B) which can be used in the present invention will be explained in detail below.

The resin (A) used in the present invention contains at least one repeating unit represented by the general formula (I) as a polymer component as described above.

In the general formula (I), $a_1$ and $a_2$ each represents a hydrogen atom, a halogen atom (e.g., chlorine and bromine), a cyano group or a hydrocarbon group, preferably including an alkyl group having from 1 to 4 carbon atoms (e.g., methyl, ethyl, propyl and butyl). $R_1$ preferably represents an alkyl group having from 1 to 18 carbon atoms which may be substituted (e.g., methyl, ethyl, propyl, butyl, pentyl, hexyl, octyl, decyl, dodecyl, tridecyl, tetradecyl, 2-chloroethyl, 2-bromoethyl, 2-cyanoethyl, 2-hydroxyethyl, 2-methoxyethyl, 2-ethoxyethyl, and 3-hydroxypropyl), an alkenyl group having from 2 to 18 carbon atoms which may be substituted (e.g., vinyl, allyl, isopropenyl, butenyl, hexenyl, heptenyl, and octenyl), an aralkyl group having from 7 to 12 carbon atoms which may be substituted (e.g., benzyl, phenethyl, naphthylmethyl, 2-naphthylethyl, methoxybenzyl, ethoxybenzyl, and methylbenzyl), a cycloalkyl group having from 5 to 8 carbon atoms which may be substituted (e.g., cyclopentyl, cyclohexyl, and cycloheptyl), or an aryl group which may be substituted (e.g., phenyl, tolyl, xylyl, mesityl, naphthyl, methoxyphenyl, ethoxyphenyl, fluorophenyl, difluorophenyl, bromophenyl, chlorophenyl, dichlorophenyl, iodophenyl, methoxycarbonylphenyl, ethoxycarbonylphenyl, cyanophenyl, and nitrophenyl).

More preferably, the polymer component corresponding to the repeating unit represented by the general formula (I) is a methacrylate component having the specific aryl group represented by the general formula (IIa) and/or (IIb) (Resin (A')) described above.

In the general formula (IIa), $A_1$ and $A_2$ each preferably represents a hydrogen atom, a chlorine atom, a bromine atom, a hydrocarbon group (preferably, an alkyl group having from 1 to 4 carbon atoms (e.g., methyl, ethyl, propyl, and butyl), an aralkyl group having from 7 to 9 carbon atoms which may be substituted (e.g., benzyl, phenethyl, 3-phenylpropyl, chlorobenzyl, dichlorobenzyl, bromobenzyl, methylbenzyl, methoxybenzyl, and chloromethylbenzyl), an aryl group which may be substituted (e.g., phenyl, tolyl, xylyl, bromophenyl, methoxyphenyl, chlorophenyl, and dichlorophenyl), $-COD_1$ or $-COOD_2$, wherein $D_1$ and $D_2$ each preferably represent any of the above-recited hydrocarbon groups as preferred hydrocarbon groups for $A_1$ and $A_2$.

In the general formula (IIa), $B_1$ is a mere bond or a linking group containing from 1 to 4 linking atoms, e.g $-(CH_2)_{n1}$ ($n_1$ represents an integer of 1, 2 or 3), $-CH_2OCO-$, $-CH_2CH_2OCO-$, $-(CH_2O)_{n2}$ ($n_2$ represents an integer of 1 or 2), and $-CH_2CH_2O-$, which connects —COO— and the benzene ring.

In the general formula (IIb), $B_2$ has the same meaning as $B_1$ in the general formula (Ia).

Specific examples of the copolymer component corresponding to the repeating unit represented by the general formula (IIa) or (IIb) which can be used in the resin (A') according to the present invention are described below, but the present invention should not be construed as being limited thereto. In the following formulae, $T_1$ and $T_2$ each represent Cl, Br or I; $R_{11}$ represents $-C_aH_{2a+1}$ or

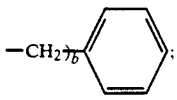

a represents an integer of from 1 to 4; b represents an integer of from 0 to 3; and c represents an integer of from 1 to 3.

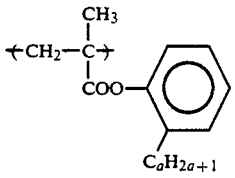
i-1)

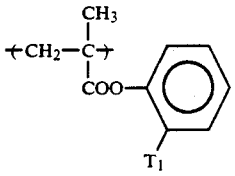
i-2)

-continued

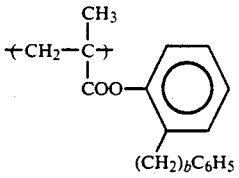
i-3)

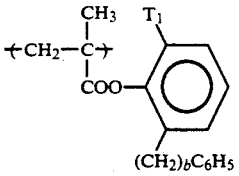
i-4)

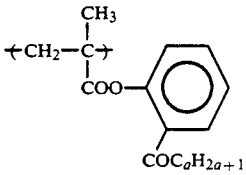
i-5)

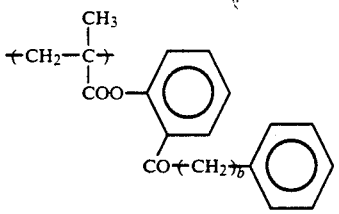
i-6)

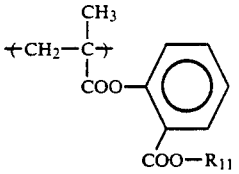
i-7)

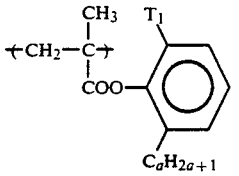
i-8)

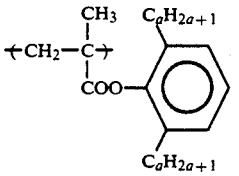
i-9)

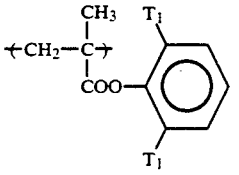
i-10)

-continued i-11)

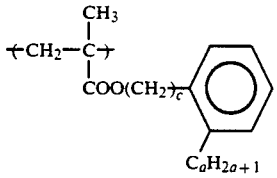

i-12)

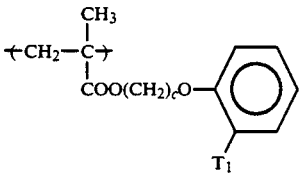

i-13)

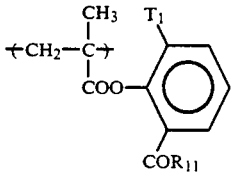

i-14)

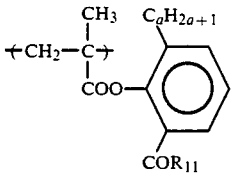

i-15)

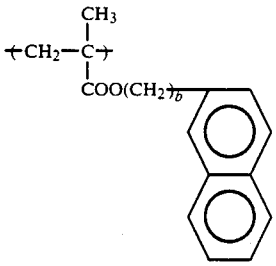

i-16)

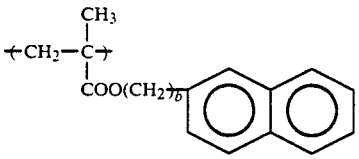

i-17)

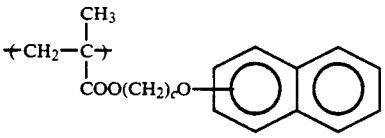

i-18)

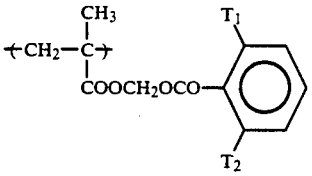

i-19)

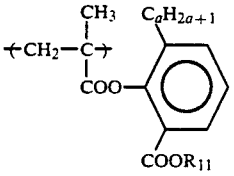

-continued i-20)

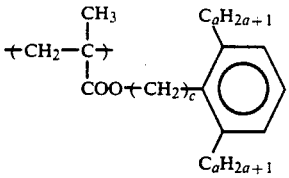

As a copolymer component containing the acidic group contained in the binder resin (A) used in the present invention, any vinyl compound having the acidic group capable of copolymerization with a polymerizable monomer corresponding to the repeating unit shown by formula (I) (including the repeating unit shown by formula (IIa) or (IIb)) may be used.

For example, such vinyl compounds are described in *Macromolecular Data Handbook* (*Foundation*), edited by Kobunshi Gakkai, Baifukan (1986). Specific examples of the vinyl compound are acrylic acid, α- and/or β-substituted acrylic acid (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and ester derivatives or amide derivatives of these carboxylic acids or sulfonic acids having the acidic group in the substituent thereof.

In the

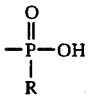

group as an acidic group, R represents a hydrocarbon group or a —OR′ group (wherein R′ represents a hydrocarbon group), and, preferably, R and R′ each represents an aliphatic group having from 1 to 22 carbon atoms which may be substituted (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and an aryl group which may be substituted (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphtnalenedicarboxylic acid anhydride ring, pyridinedicarboxylic acid anhydride ring and thiophenedicarboxyic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

Specific examples of the copolymerizable components having the acidic group are illustrated below, but the present invention should not be construed as being limited thereto.

In the following formulae, $P_1$ represents H or $CH_3$; $P_2$ represents H, $CH_3$, or $CH_2COOCH_3$; $R_{12}$ represents an alkyl group having from 1 to 4 carbon atoms; $R_{13}$ represents an alkyl group having from 1 to 6 carbon atoms, a benzyl group, or a phenyl group; c represents an integer of from 1 to 3; d represents an integer of from 2 to 11; e represents an integer of from 1 to 11; f represents an integer of from 2 to 4; and g represents an integer of from 2 to 10.

ii-1)

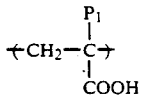

ii-2)

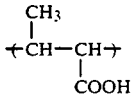

ii-3)

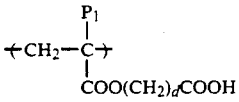

ii-4)

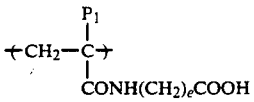

ii-5)

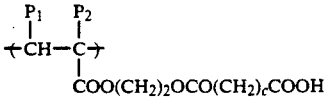

ii-6)

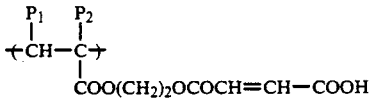

ii-7)

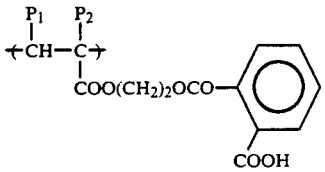

-continued ii-8)

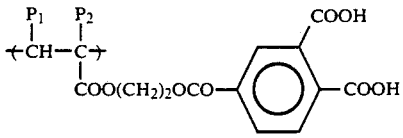

ii-9)

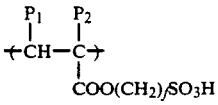

ii-10)

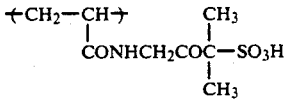

ii-11)

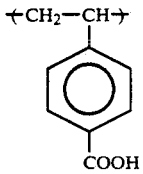

ii-12)

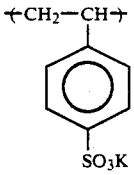

ii-13)

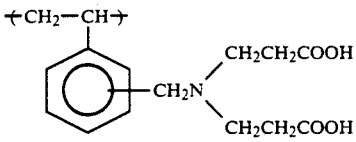

ii-14)

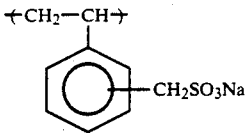

ii-15)

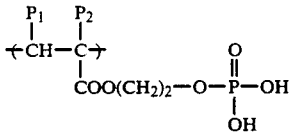

ii-16)

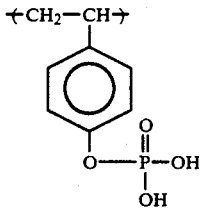

ii-17)

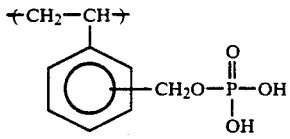

-continued ii-18)

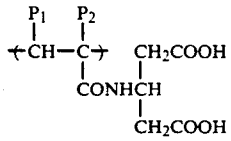

ii-19)

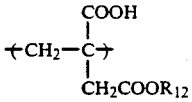

ii-20)

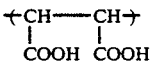

ii-21)

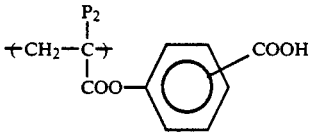

ii-22)

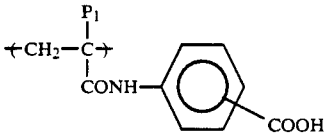

ii-23)

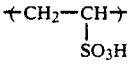

ii-24)

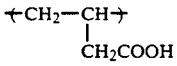

ii-25)

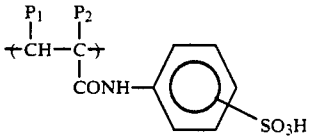

ii-26)

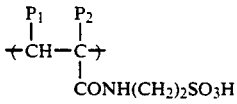

ii-27)

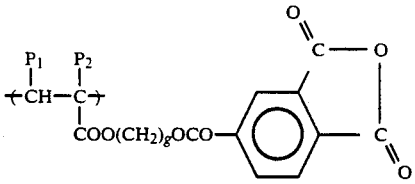

ii-28)

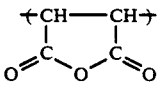

ii-29)

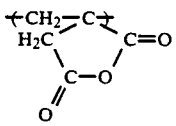

ii-30)

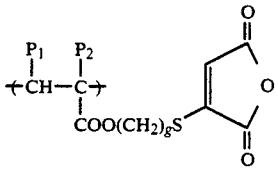

-continued ii-31)

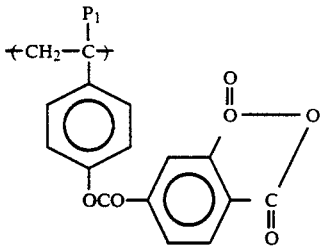

ii-32)

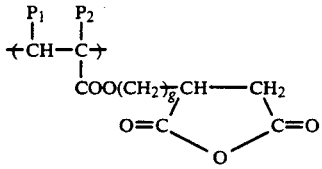

ii-33)

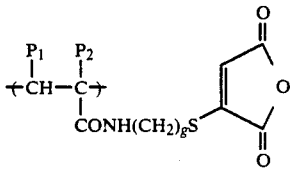

ii-34)

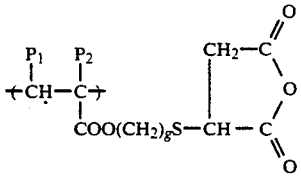

ii-35)

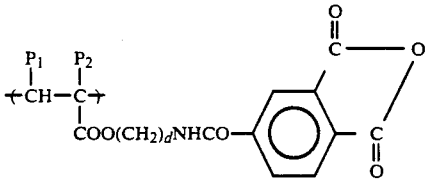

ii-36)

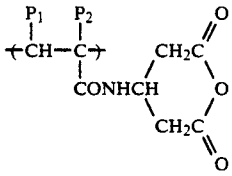

ii-37

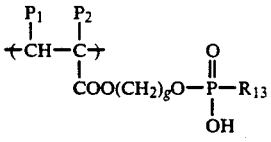

ii-38)

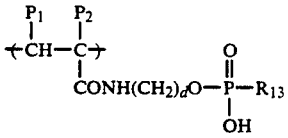

In the binder resin (A), the above-described acidic group contained in the copolymer component of the polymer may be the same as or different from the acidic group bonded to the terminal of the polymer main chain.

The acidic group which is bonded to one of the terminals of the polymer main chain in the resin (A) according to the present invention preferably includes —$PO_3H_2$, —$SO_3H$, —COOH,

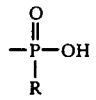

(wherein R is as defined above), and a cyclic acid anhydride-containing group.

The above-described acidic group may be bonded to one of the polymer main chain terminals either directly or via an appropriate linking group.

The linking group can be any group for connecting the acidic group to the polymer main chain terminal. Specific examples of suitable linking group include

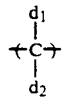

(wherein $d_1$ and $d_2$, which may be the same or different, each represents a hydrogen atom, a halogen atom (e.g., chlorine, and bromine), a hydroxyl group, a cyano group, an alkyl group (e.g., methyl, ethyl, 2-chloroethyl, 2-hydroxyethyl, propyl, butyl, and hexyl), an aralkyl group (e.g., benzyl, and phenethyl), and an aryl group (e.g.,

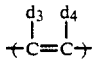

(wherein $d_3$ and $d_4$ each has the same meaning as defined for $d_1$ or $d_2$ above),

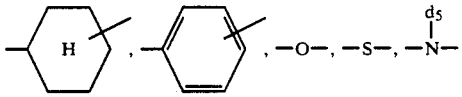

(wherein $d_5$ represents a hydrogen atom or a hydrocarbon group preferably having from 1 to 12 carbon atoms (e.g., methyl, ethyl, propyl, butyl, hexyl, octyl, decyl, dodecyl, 2-methoxyethyl, 2-chloroethyl, 2cyanoethyl, benzyl, methylbenzyl, chlorobenzyl, methoxybenzyl, phenethyl, phenyl, tolyl, chlorophenyl, methoxyphenyl, and butylphenyl), —CO—, —COO—, —OCO—,

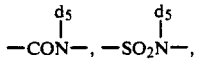

—$SO_2$—, —NHCONH—, —NHCOO—, —$NHSO_2$—, —CONHCOO—, —CONHCONH—, a heterocyclic ring (preferably a 5-membered or 6-membered ring containing at least one of an oxygen atom, a sulfur atom and a nitrogen atom as a hetero atom or a condensed ring thereof (e.g., thiophene, pyridine, furan, imidazole, piperidine, and morpholine)),

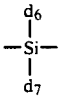

(wherein $d_6$ and $d_7$, which may be the same or different, each represents a hydrocarbon group or —$Od_8$ (wherein $d_8$ represents a hydrocarbon group)), and a combination thereof. Suitable example of the hydrocarbon group represented by $d_6$, $d_7$ or $d_8$ include those described for $d_5$.

Moreover, the binder resin (A) preferably contains from 1 to 20% by weight of a copolymer component having a heat- and/or photo-curable functional group in addition to the copolymer component represented by the general formula (I) (including that represented by the general formula (IIa) or (IIb)) and the copolymer component having the acidic group described above, in view of achieving higher mechanical strength.

The term "heat- and/or photo-curable functional group" as used herein means a functional group capable of inducing curing reaction of a resin on application of at least one of heat and light.

Specific examples of the photo-curable functional group include those used in conventional light-sensitive resins known as photocurable resins as described, for example, in Hideo Inui and Gentaro Nagamatsu, *Kankosei Kobunshi,* Kodansha (1977), Takahiro Tsunoda, *Shin-Kankosei Jushi,* Insatsu Gakkai Shuppanbu (1981), G. E. Green and B. P. Strak, *J. Macro. Sci. Reas. Macro. Chem.,* C 21 (2), pp. 187 to 273 (1981–82), and C. G. Rattey, *Photopolymerization of Surface Coatings,* A. Wiley Interscience Pub. (1982).

The heat-curable functional group which can be used includes functional groups excluding the above-specified acidic groups. Examples of the heat-curable functional groups are described, for example, in Tsuyoshi Endo, *Netsukokasei Kobunshi no Seimitsuka,* C.M.C. (1986), Yuji Harasaki, *Saishin Binder Gijutsu Binran,* Chapter II-I, Sogo Gijutsu Center (1985), Takayuki Ohtsu, *Acryl Jushi no Gosei Sekkei to Shin-Yotokaihatsu,* Chubu Kei-ei Kaihatsu Center Shuppanbu (1985), and Eizo Ohmori, *Kinosei Acryl Kei Jushi,* Techno System (1985).

Specific examples of the heat-curable functional group which can be used include —OH, —SH, —$NH_2$, —$NHR_3$ (wherein $R_3$ represents a hydrocarbon group, for example, an alkyl group having from 1 to 10 carbon atoms which may be substituted (e.g., methyl, ethyl, propyl, butyl, hexyl, octyl, decyl, 2-chloroethyl, 2-methoxyethyl, and 2-cyanoethyl), a cycloalkyl group having from 4 to 8 carbon atoms which may be substituted (e.g., cycloheptyl and cyclohexyl), an aralkyl group having from 7 to 12 carbon atoms which may be substituted (e.g., benzyl, phenethyl, 3-phenylpropyl, chlorobenzyl, methylbenzyl, and methoxybenzyl), and an aryl group which may be substituted (e.g., phenyl, tolyl, xylyl, chlorophenyl, bromophenyl, methoxyphenyl, and naphthyl)),

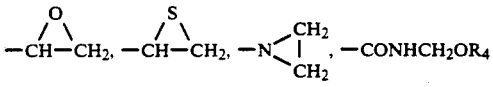

(wherein $R_4$ represents a hydrogen atom or an alkyl group having from 1 to 8 carbon atoms (e.g., methyl, ethyl, propyl, butyl, hexyl, and octyl)), —N=C=O and

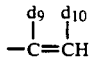

(wherein $d_9$ and $d_{10}$ each represents a hydrogen atom, a halogen atom (e.g., chlorine and bromine) or an alkyl group having from 1 to 4 carbon atoms (e.g., methyl and ethyl)).

Other examples of the functional group include polymerizable double bond groups, for example,

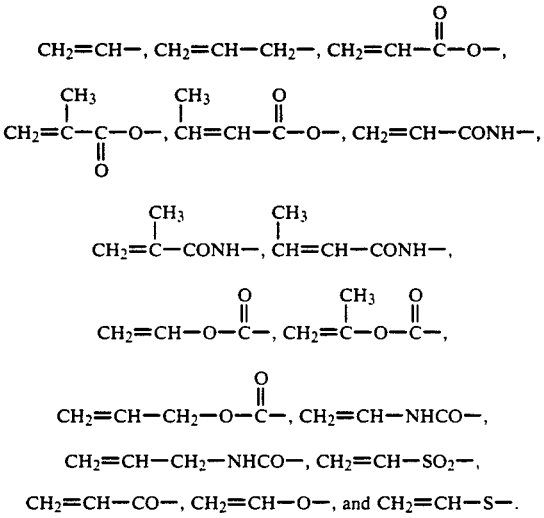

In order to introduce at least one functional group selected from the curable functional groups into the binder resin according to the present invention, a method comprising introducing the functional group into a polymer by high molecular reaction or a method comprising copolymerizing at least one monomer containing at least one of the functional groups with a polymerizable monomer corresponding to the repeating unit of the general formula (I) (including that of the general formula (IIa) or (IIb)) and a polymerizable monomer corresponding to the acidic group-containing polymer component can be employed.

The above-described high molecular reaction can be carried out by using conventionally known low molecular synthesis reactions. For the details, reference can be made to, e.g., Nippon Kagakukai (ed.), *Shin-Jikken Kagaku Koza,* Vol. 14, "Yuki Kagobutsu no Gosei to Hanno" (I) to (V), published by Maruzen Co., and Yoshio Iwakura and Keisuke Kurita, *Hannosei Kobunshi,* and literature references cited therein.

Suitable examples of the monomers containing the functional group capable of inducing heat- and/or photo-curable reaction include vinyl compounds which are copolymerizable with polymerizable monomers corresponding to the repeating unit of the general formula (I) and contain the above-described functional group. More specifically, compounds similar to those described in detail above as the acidic group-containing components which further contain the above-described functional group in their substituent are illustrated.

Specific examples of the heat- and/or photocurable functional group-containing repeating unit are described below, but the present invention should not be construed as being limited thereto. In the following formulae, $R_{11}$, a, d and e each has the same meaning as defined above; $P_1$ and $P_3$ each represents —H or —$CH_3$; $R_{14}$ represents —CH=$CH_2$ or —$CH_2$CH=$CH_2$; $R_{15}$ represents —CH=$CH_2$,

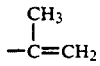

or —CH=$CHCH_3$; $R_{16}$ represents —CH=$CH_2$, —$CH_2$CH=$CH_2$,

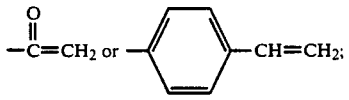

Z represents S or O; $T_3$ represents —OH or —$NH_2$; h represents an integer of from 1 to 11; i represents an integer of from 1 to 10.

iii-1)

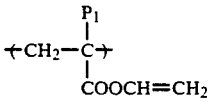

iii-2)

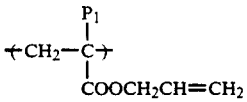

iii-3)

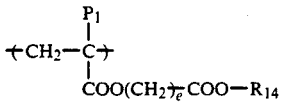

iii-4)

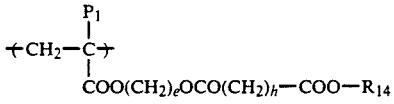

iii-5)

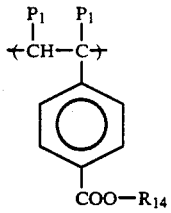

iii-6)

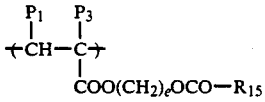

iii-7)

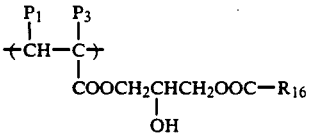

iii-8)

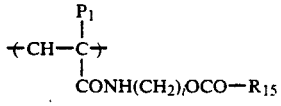

-continued iii-9)

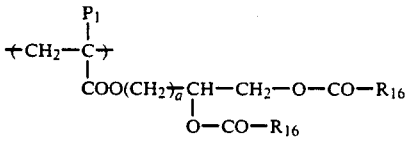

iii-10)

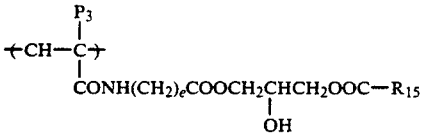

iii-11)

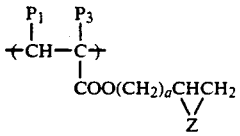

iii-12)

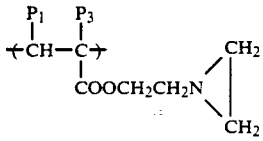

iii-13)

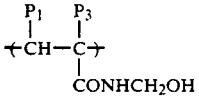

iii-14)

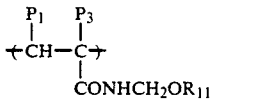

iii-15)

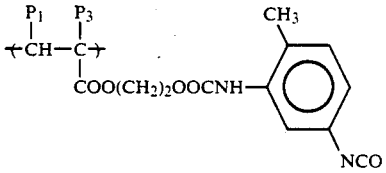

iii-16)

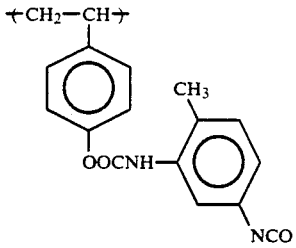

iii-17)

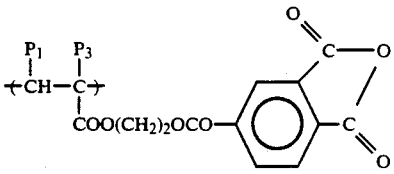

iii-18)

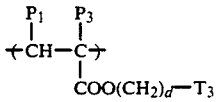

iii-19)

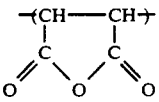

-continued iii-20)

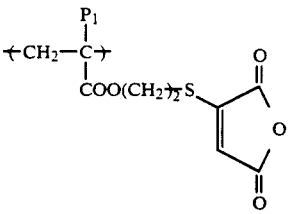

The resin (A) according to the present invention may further comprise other copolymer monomers as copolymer components in addition to the monomer corresponding to the repeating unit of the general formula (I) (including that of the general formula (IIa) or (IIb) and the monomer containing the acidic group. Examples of such monomers include, in addition to methacrylic acid esters, acrylic acid esters and crotonic acid esters containing substituents other than those described for the general formula (I), α-olefins, vinyl or allyl esters of alkanoic acids (including, e.g., acetic acid, propionic acid, butyric acid, and valeric acid, as examples of the alkanoic acids), acrylonitrile, methacrylonitriie, vinyl ethers, itaconic acid esters (e.g., dimethyl ester, and diethyl ester), acrylamides, methacrylamides, styrenes (e.g., styrene, vinyltoluene, chlorostyrene, hydroxystyrene, N,N-dimethylaminomethylstyrene, methoxycarbonylstyrene, methanesulfonyloxystyrene, and vinylnaphthalene), and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole, and vinyloxazine).

The resin (A) according to the present invention, in which the specific acidic group is bonded to only one terminal of the polymer main chain, can easily be prepared by an ion polymerization process, in which a various kind of a reagent is reacted at the terminal of a living polymer obtained by conventionally known anion polymerization or cation polymerization; a radical polymerization process, in which radical polymerization is performed in the presence of a polymerization initiator and/or a chain transfer agent which contains the specific acidic group in the molecule thereof; or a process, in which a polymer having a reactive group (for example, an amino group, a halogen atom, an epoxy group, and an acid halide group) at the terminal obtained by the above-described ion polymerization or radical polymerization is subjected to a high molecular reaction to convert the terminal reactive group into the specific acidic group.

More specifically, reference can be made to, e.g., P. Dreyfuss and R. P. Quirk, *Encycl. Polym. Sci. Eng.*, Vol. 7, p. 551 (1987), Yoshiki Nakajo and Yuya Yamashita, *Senryo to Yakuhin*, Vol. 30, p. 232 (1985), Akira Ueda and Susumu Nagai, *Kagaku to Kogyo*, Vol. 60, p. 57 (1986) and literature references cited therein.

Specific examples of chain transfer agents which can be used include mercapto compounds containing the acidic group or the reactive group capable of being converted into the acidic group (e.g., thioglycolic acid, thiomalic acid, thiosalicyclic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mecaptobutanesulfonic acid, 2-mercaptoethanol, 1-mercapto-2-propanol, 3-mercapto-2-butanol, mercaptophenol, 2-mercaptoethylamine, 2-mercaptoimidazole, 2-mercapto-3-pyridinol, 4-(2-mercaptoethyloxycarbonyl)phthalic anhydride, 2-mercaptoethylphosphonic acid, and monomethyl 2-mercaptoethylphosphonate), and alkyl iodide compounds containing the acidic group or the acidic group-forming reactive group (e.g., iodoacetic acid, iodopropionic acid, 2-iodoethanol, 2-iodoethanesulfonic acid, and 3-iodopropanesulfonic acid). Of these compounds, mercapto compounds are preferred.

Specific examples of the polymerization initiators containing the acidic group or the reactive group include 4,4'-azobis(4-cyanovaleric acid), 4,4'-azobis(4-cyanovaleric acid chloride), 2,2'-azobis(2-cyanopropanol), 2,2'-azobis(2-cyanopentanol), 2,2'-azobis[2-methyl-N-(2-hydroxyethyl)propionamide], 2,2'-azobis{2-methyl-N-[1,1-bis(hydroxymethyl)-2-hydroxyethyl]propionamide}, 2,2'- azobis{2-[1-(2-hydroxyethyl)-2-imidazolin-2-yl]propane}, 2,2'-azobis[2-(2-imidazolin-2-yl)propane], and 2,2'-azobis[2-(4,5,6,7-tetrahydro-1H-1,3-diazepin-2-yl)propane].

The chain transfer agent or polymerization initiator is usually used in an amount of from 0.5 to 15 parts by weight, preferably from 2 to 10 parts by weight, per 100 parts by weight of the total monomers.

Now, the resin (B) will be described in detail with reference to preferred embodiments below.

The resin (B) used in the present invention contains at least one repeating unit represented by formula (III) described above as a polymer component.

In formula (III), $b_1$ and $b_2$ have the same meaning as $a_1$ and $a_2$ in formula (I) described above.

X represents $-(CH_2)_n COO-$, $-(CH_2)_m OCO-$, —O—, or $$-\underset{\underset{O}{\|}}{C}-$$

(wherein n and m each represents O or an integer of from 1 to 3). X is preferably —COO—, —OCO—, —O—, $-CH_2COO-$, $-CH_2OCO-$, or —O—.

$R_2$ has the same meaning as $R_1$ in formula (I).

The resin (B) may contain a polymer component containing at least one acidic group selected from —COOH, $-PO_3H_2$, $-SO_3H$, $$-\overset{\overset{O}{\|}}{\underset{\underset{OH}{|}}{P}}-R_o$$

(wherein $R_o$ has the same meaning as R), and an acid anhydride-containing group. The acid group-containing copolymer component may be any monomer containing the acidic group capable of being copolymerized with a polymerizable monomer corresponding to the repeating unit represented by formula (III) and practically, the same compounds as the monomers which are used for the resin (A) as described above are used.

Furthermore, as the acidic group bonded to one terminal of the polymer main chain in the binder resin (B') used in the present invention, preferred examples thereof include $-PO_3H_2$, $-SO_3H$, —COOH, $$-\overset{\overset{O}{\|}}{\underset{\underset{R}{|}}{P}}-OH,$$

and a cyclic acid anhydride-containing group. Specific examples of the linking group which bonds the acidic group to the main chain are the same as those described above for the binder resin (A').

In the resin (B'), the above-described acidic group contained in the copolymer component of the polymer may be the same as or different from the acidic group bonded to the terminal of the main chain of the polymer.

Furthermore, the resin (B) may contain a component which may be the same as "the copolymerizable component containing a (crosslinkable) functional group" which may be contained in the resin (A) and the content thereof is preferably from 0.1 to 20% by weight.

Also, the resin (B) used in the present invention may further contain other polymer components then the polymer component shown by formula (III) and the polymer component having the acidic group. Specific examples of such other polymer components are the same as the compounds illustrated above as the other polymer components in the resin (A). However, in this case, the content of other polymer components existing in the binder (B) is less than 30% by weight, and preferably less than 20% by weight.

Of the resin (B) used in the present invention, the resin (B') having the acidic group bonded to the terminal of the polymer main chain can be synthesized by using a polymerization initiator or a chain transfer agent each having the acidic group or a specific reactive group capable of being converted into the acidic group in the molecule at the polymerization of the above-described monomers, and specifically can be obtained by the same method as the synthesis of the resin (A'). The weight average molecular weight of the resin can be controlled in the desired range by properly selecting the kinds of the polymerization initiator and the chain transfer agent, the amounts of these components, the polymerization temperature, the concentration of the monomers, the polymerization solvent, etc., as conventionally known in a polymerization reaction.

The ratio of resin (A) to resin (B) used in the present invention differs depending upon the type and particle sizes of the inorganic photoconductive substance used and the surface state thereof, but, in general, the ratio of resin (A)/resin (B) is 5 to 60/95 to 40, and preferably 10 to 50/90 to 50 by weight.

Also, when the resin (A) and/or the resin (B) used in the present invention contains a photo- and/or heat-curable functional group, a crosslinking agent for accelerating the crosslinking of the resin(s) in the layer can be employed together. As the crosslinking agent, compounds which are ordinary used as crosslinking agents can be used. Specifically, these compounds are described, for example, in Shinzo Yamashita and Tosuke Kaneko, *Kakyozai* (*Crosslinking Agent*) *Handbook*, published by Taiseisha, 1981, and Kobunshi Gakkai (ed.), *Kobunshi* (*Polymer*) *Data Handbook Kisohen* (*Foundation*), Baifukan, 1986.

Specific examples of the crosslinking agent are organic silane series compounds (e.g., silane coupling agents such as vinyltrimethoxysilane, vinyltributoxysilane, γ-glycidoxypropyltrimethoxysilane, γ-mercaptopropyltriethoxysilane, and γ-aminopropyltriethoxysilane), polyisocyanate series compounds (e.g., toluylene diisocyanate, o-toluylene diisocyanate, diphenylmethane diisocyanate, triphenylmethane triisocyanate, polymethylenepolyphenyl isocyanate, hexamethylene diisocyanate, isophorone diisocyanate, and high molecular polyisocyanate), polyol series compounds (e.g., 1,4-butanediol, polyoxypropylene glycol, polyoxyalkylene glycol, and 1,1,1-trimethylolpropane), polyamine series compounds (e.g., ethylenediamine, γ-hydroxypropylated ethylenediamine, phenylenediamine, hexamethylenediamine, N-aminoethylpiperazine, and modified aliphatic polyamines), polyepoxy group-containing compounds and epoxy resins (e.g., the compounds described in Hiroshi Kakiuchi, *Epoxy Resin,* published by Shokodo (1985), Kuniyuki Hashimoto, *Epoxy Resin,* published by Nikkan Kogyo Shinbunsha (1969), melamine resins (e.g., the compounds described in Ichiro Miwa & Hideo Matsunaga, *Urea.Melamine Resins,* published by Nikkan Kogyo Shinbunsha (1969)), and poly(meth)acrylate series compounds (e.g., the compounds described in Shin Ohgawara, Takeo Saegusa, & Thoshinobu Higashimura, *Oligomer,* published by Kodansha (1976), Eizo Ohmori, *Kinosei (Functional) Acrylic Resins,* published by Techno System (1985), specific examples including polyethylene glycol diacrylate, neopentyl glycol diacrylate, 1,6-hexanediol acrylate, trimethylolpropane triacrylate, pentaerythritol polyacrylate, bisphenol A diglycidyl ether acrylate, oligoester acrylate and methacrylate compounds thereof).

The amount of the crosslinking agent used in the present invention is preferably from 0.5 to 30% by weight, and more preferably from 1 to 10% by weight.

In the present invention, if necessary, a reaction accelerator may be added to the binder resin for accelerating the crosslinking reaction in the photoconductive layer.

In the case of the reaction system wherein the crosslinking reaction forms a chemical bond between functional groups, examples of the reaction accelerator are organic acids such as acetic acid, propionic acid, butyric acid, benzenesulfonic acid, or p-toluenesulfonic acid.

When the crosslinking reaction is a polymerizing reaction system, examples of the reaction accelerator are polymerization initiators (e.g., peroxides and azobis series compounds, and preferably azobis series polymerization initiators) and monomers having a polyfunctional polymerizable group (e.g., vinyl methacrylate, allyl methacrylate, ethylene glycol acrylate, polyethylene glycol diacrylate, divinylsuccinic acid ester, divinyladipic acid ester, diallylsuccinic acid ester, 2-methylvinyl methacrylate, and divinylbenzene).

Furthermore, in the present invention, the binder resin used may contain other resin(s). Examples of such resins are alkyd resins, polybutyral resins, polyolefins, ethylene-vinyl acetate copolymers, styrene resins, styrene-butadiene resins, acrylate-butadiene resins, and vinyl alkanoate resins.

The amount of other resins descried above should not exceed 30% by weight of the total binder resins since, if the amount is more than 30% by weight, the effect of the present invention, in particular, the improvement of electrostatic characteristics, cannot be achieved.

When the binder resin used in the present invention contains a photo- and/or heat-curable functional group in the binder resin (A) and/or the binder resin (B), the coated layer is crosslinked or heat-cured after coating the coating composition for forming the photoconductive layer. For carrying out the crosslinking or heat-curing, for example, the drying condition is adjusted severer than the drying condition for making conventional electrophotographic light-sensitive materials. For example, drying is carried out at a high temperature and/or for a long time, or, preferably after drying the coated layer, the layer is further subjected to a heat treatment. For example, the coated layer is treated at a temperature of from 60° C. to 120° C. for from 5 to 120 minutes. Furthermore, when the above-described reaction accelerator is used, the coated layer can be treated under a milder condition.

The inorganic photoconductive substance which can be used in the present invention includes zinc oxide, titanium oxide, zinc sulfide, cadmium sulfide, cadmium carbonate, zinc selenide, cadmium selenide, tellurium selenide, and lead sulfide, preferably zinc oxide.

The resin binder is used in a total amount of from 10 to 100 parts by weight, preferably from 15 to 50 parts by weight, per 100 parts by weight of the inorganic photoconductive substance.

Various dyes can be used as spectral sensitizer in the present invention. Examples of the spectral sensitizers are carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (including metallized dyes). Reference can be made to, for example, in Harumi Miyamoto and Hidehiko Takei, *Imaging,* 1973, No. 8, 12, C. J. Young et al., *RCA Review,* 15, 469 (1954), Ko-hei Kiyota et al., *Denkitsushin Gakkai Ronbunshi,* J 63-C, No. 2, 97 (1980), Yuji Harasaki et al., *Kogyo Kagaku Zasshi,* 66, 78 and 188 (1963), and Tadaaki Tani, *Nihon Shashin Gakkaishi,* 35, 208 (1972).

Specific examples of the carbonium dyes, triphenylmethane dyes, xanthene dyes, and phthalein dyes are described, for example, in JP-B-51-452, JP-A-50-90334, JP-A-50-114227, JP-A-53-39130, JP-A-53-82353, U.S. Pat. Nos. 3,052,540 and 4,054,450, and JP-A-57-16456.

The polymethine dyes, such as oxonol dyes, merocyanine dyes, cyanine dyes, and rhodacyanine dyes, include those described, for example, in F. M. Hammer, *The Cyanine Dyes and Related Compounds.* Specific examples include those described, for example, in U.S. Pat. Nos. 3,047,384, 3,110,591, 3,121,008, 3,125,447, 3,128,179, 3,132,942, and 3,622,317, British Patents 1,226,892, 1,309,274 and 1,405,898, JP-B-48-7814 and JP-B-55-18892.

In addition, polymethine dyes capable of spectrally sensitizing in the longer wavelength region of 700 nm or more, i.e., from the near infrared region to the infrared region, include those described, for example, in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research disclosure,* 216, 117 to 118 (1982).

The light-sensitive material of the present invention is particularly excellent in that the performance properties are not liable to variation even when combined with various kinds of sensitizing dyes.

If desired, the photoconductive layer may further contain various additives commonly employed in conventional electrophotographic light-sensitive layer, such as chemical sensitizers. Examples of such additives include electron-accepting compounds (e.g., halogen, benzoquinone, chloranil, acid anhydrides, and organic carboxylic acids) as described in the above-mentioned *Imaging*, 1973, No. 8, 12; and polyarylalkane compounds, hindered phenol compounds, and p-phenylenediamine compounds as described in Hiroshi Kokado et al., *Saikin-no Kododen Zairyo to Kankotai no Kaihatsu Jitsuyoka*, Chaps. 4 to 6, Nippon Kagaku Joho K.K. (1986).

The amount of these additives is not particularly restricted and usually ranges from 0.0001 to 2.0 parts by weight per 100 parts by weight of the photoconductive substance.

The photoconductive layer suitably has a thickness of from 1 to 100 μm, preferably from 10 to 50 μm.

In cases where the photoconductive layer functions as a charge generating layer in a laminated light-sensitive material composed of a charge generating layer and a charge transporting layer, the thickness of the charge generating layer suitably ranges from 0.01 to 1 μm, particularly from 0.05 to 0.5 μm.

If desired, an insulating layer can be provided on the light-sensitive layer of the present invention. When the insulating layer is made to serve for the main purposes for protection and improvement of durability and dark decay characteristics of the light-sensitive material, its thickness is relatively small. When the insulating layer is formed to provide the light-sensitive material suitable for application to special electrophotographic processes, its thickness is relatively large, usually ranging from 5 to 70 μm, particularly from 10 to 50 μm.

Charge transporting material in the above-described laminated light-sensitive material include polyvinylcarbazole, oxazole dyes, pyrazoline dyes, and triphenylmethane dyes. The thickness of the charge transporting layer ranges from 5 to 40 μm, preferably from 10 to 30 μm.

Resins to be used in the insulating layer or charge transporting layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylate resins, polyolefin resins, urethane resins, epoxy resins, melamine resins, and silicone resins.

The photoconductive layer according to the present invention can be provided on any known support. In general, a support for an electrophotographic light-sensitive layer is preferably electrically conductive. Any of conventionally employed conductive supports may be utilized in the present invention. Examples of usable conductive supports include a substrate (e.g., a metal sheet, paper, and a plastic sheet) having been rendered electrically conductive by, for example, impregnating with a low resistant substance; the above-described substrate with the back side thereof (opposite to the light-sensitive layer side) being rendered conductive and having further coated thereon at least one layer for the purpose of prevention of curling; the above-described substrate having provided thereon a water-resistant adhesive layer; the above-described substrate having provided thereon at least one precoat layer; and paper laminated with a conductive plastic film on which aluminum is vapor deposited.

Specific examples of conductive supports and materials for imparting conductivity are described, for example, in Yukio Sakamoto, *Denshishashin*, 14, No. 1, pp. 2 to 11 (1975), Hiroyuki Moriga, *Nyumon Tokushushi no Kagaku*, Kobunshi Kankokai (1975), and M. F. Hoover, *J. Macromol. Sci. Chem.*, A-4(6), pp. 1327 to 1417 (1970).

The present invention will now be illustrated in greater detail with reference to the following examples, but it should be understood that the present invention is not to be construed as being limited thereto.

SYNTHESIS EXAMPLE 1 OF THE RESIN (A): (A-1)

A mixed solution of 98 g of benzyl methacrylate, 2 g of acrylic acid, 3 g of thiosalicylic acid, and 200 g of toluene was heated to 70° C. under a nitrogen gas stream.

Then, after adding 1.0 g of 2,2'-azobisisobutyronitrile (abbreviated as A.I.B.N.) to the above mixture, the reaction was carried out for 4 hours. Then, after adding thereto 0.4 g of A.I.B.N., the mixture was stirred for 2 hours and, after further adding thereto 0.2 g of A.I.B.N., the mixture was stirred for 3 hours. The weight average molecular weight ($\overline{M}w$) of the resulting copolymer (A-1) was $6.5\times10^3$.

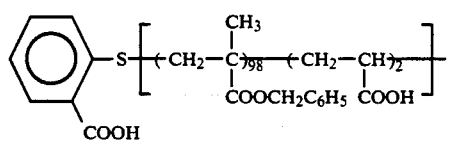

(A-1)

SYNTHESIS EXAMPLES 2 TO 16 OF RESIN (A): (A-2) TO (A-16)

Each of resins (A) shown in Table 1 was synthesized by following the same procedure as Synthesis Example 1 of Resin (A) except that each of the monomers shown in Table 1 below was used in place of 98 g of benzyl methacrylate and 2 g of acrylic acid. The weight average molecular weights of the resins obtained were from $6\times10^3$ to $8\times10^3$.

TABLE 1
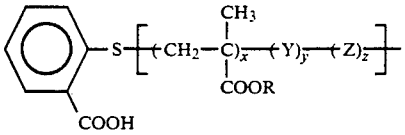
| Synthesis Example of Resin (A) | Resin (A) | R | —Y— | —Z— | x/y/z (weight ratio) |
|---|---|---|---|---|---|
| 2 | A-2 | $-C_2H_5$ | — | $-CH_2-C(CH_3)(COOH)-$ | 97/0/3.0 |
| 3 | A-3 | $-C_3H_7$ | — | $-CH_2-C(CH_3)(COOH)-$ | 96.5/0/3.5 |
| 4 | A-4 | $-CH_2C_6H_5$ | — | $-CH(CH_3)-CH(COOH)-$ | 98/0/2.0 |
| 5 | A-5 | $-CH_2C_6H_5$ | $-CH_2-CH(COOCH_3)-$ | $-CH(COOH)-C(CH_2COOH)-$ | 89/10/1.0 |
| 6 | A-6 | $-CH_3$ | $-CH_2-CH(COOC_2H_5)-$ | $-CH_2-CH(COO(CH_2)_2COOH)-$ | 82/15/3.0 |
| 7 | A-7 | $-C_6H_5$ | — | $-CH_2-CH(COOH)-$ | 98.5/0/1.5 |
| 8 | A-8 | 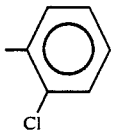 | — | " | 98/0/2.0 |
| 9 | A-9 | 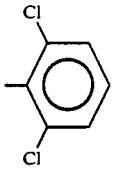 | — | $-CH_2-C(CH_3)(COOH)-$ | 97/0/3.0 |
| 10 | A-10 | 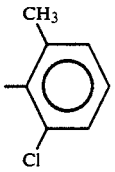 | — | $-CH_2-C(CH_3)(COO(CH_2)_2OCO(CH_2)_2COOH)-$ | 95/0/5.0 |
| 11 | A-11 | 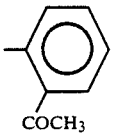 | — | $-CH_2-CH-$ 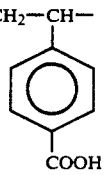 | 96/0/4.0 |

TABLE 1-continued

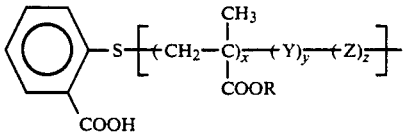

| Synthesis Example of Resin (A) | Resin (A) | R | —Y— | —Z— | x/y/z (weight ratio) |
|---|---|---|---|---|---|
| 12 | A-12 | 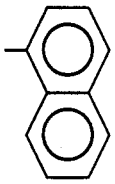 | $-CH_2-CH-$ (COOCH$_3$) | $-CH_2-CH-$ (COOH) | 82.5/15/2.5 |
| 13 | A-13 | 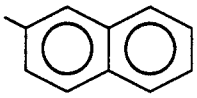 | — | $-CH_2-C-$ (CH$_3$; COO(CH$_2$)$_2$O—P(=O)(OH)—OH) | 99/0/1.0 |
| 14 | A-14 | $-CH_2-$ 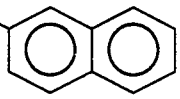 | — | $-CH_2-C-$ (CH$_3$; COO(CH$_2$)$_2$SO$_3$H) | 99.2/0/0.8 |
| 15 | A-15 | $-CH_2C_6H_5$ | — | $-CH_2-C-$ (CH$_3$; COO(CH$_2$)$_2$OCO—) 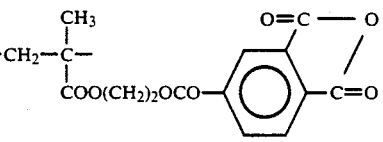 | 94/0/6.0 |
| 16 | A-16 | $-C_4H_9$ | $-CH_2-CH-$ (CN) | $-CH_2-C-$ (CH$_3$; COO(CH$_2$)$_2$COOH) | 92/5/3.0 |

SYNTHESIS EXAMPLES 17 TO 27 OF RESIN (A): (A-17) TO (A-27)

Each of resins (A) shown in Table 2 was synthesized by following the same procedure as Synthesis Example 1 of Resin(A) except that each of the methacrylates and each of the mercapto compounds shown in Table 2 below were used in place of 98 g of benzyl methacrylate and 3 g of thiosalicylic acid, and that 150 g of toluene and 50 g of isopropanol were used in place of 200 g of toluene.

TABLE 2

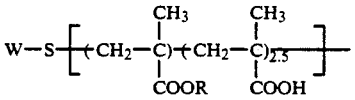

| Synthesis Example of Resin (A) | Resin (A) | Mercapto Compound (W—) | | R— | | Weight Average Molecular Weight |
|---|---|---|---|---|---|---|
| 17 | A-17 | $HOOCCH_2CH_2CH_2-$ | 4 g | $-C_2H_5$ | 96 g | $7.3 \times 10^3$ |
| 18 | A-18 | $HOOCCH_2-$ | 5 g | $-C_3H_7$ | 95 g | $5.8 \times 10^3$ |
| 19 | A-19 | HOOC—CH(HOOC—CH$_2$)— | 5 g | $-CH_2C_6H_5$ | 95 g | $7.5 \times 10^3$ |
| 20 | A-20 | $HOOCCH_2CH_2-$ | 5.5 g | $-C_6H_5$ | 94.5 g | $6.5 \times 10^3$ |

TABLE 2-continued

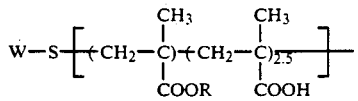

| Synthesis Example of Resin (A) | Resin (A) | Mercapto Compound (W—) | | R— | | Weight Average Molecular Weight |
|---|---|---|---|---|---|---|
| 21 | A-21 | $HOOCCH_2$— | 4 g | 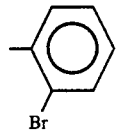 | 96 g | $5.3 \times 10^3$ |
| 22 | A-22 | 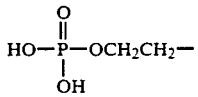 | 3 g | 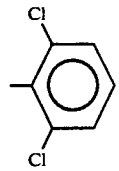 | 97 g | $6.0 \times 10^3$ |
| 23 | A-23 | $HO_3SCH_2CH_2$— | 3 g | 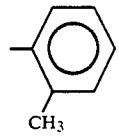 | 97 g | $8.8 \times 10^3$ |
| 24 | A-24 | 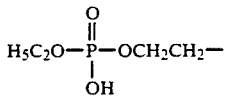 | 4 g | 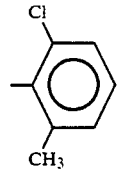 | 96 g | $7.5 \times 10^3$ |
| 25 | A-25 | 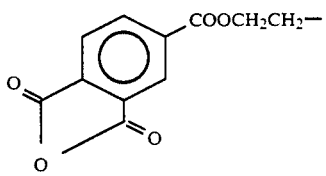 | 7 g | 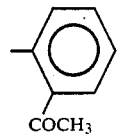 | 93 g | $5.5 \times 10^3$ |
| 26 | A-26 | 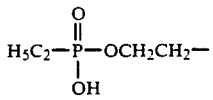 | 6 g | 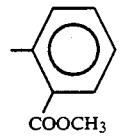 | 94 g | $4.5 \times 10^3$ |
| 27 | A-27 | 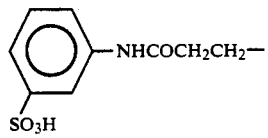 | 4 g | 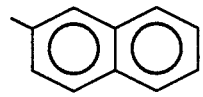 | 96 g | $5.6 \times 10^3$ |

SYNTHESIS EXAMPLE 28 OF RESIN (A): (A-28)

A mixed solution of 97 g of 1-naphthyl methacrylate, 3 g of methacrylic acid, 150 g of toluene, and 50 g of isopropanol was heated to 80° C. under a nitrogen gas stream. After adding 5.0 g of 4,4'-azobis(4-cyanovaleric acid) (abbreviated as A.C.V.) to the mixture, the resulting mixture was stirred for 5 hours. Then, after adding thereto 1 g of A.C.V., the mixture was stirred for 2 hours and, after further adding thereto 1 g of A.C.V., the mixture was stirred for 3 hours. The weight average molecular weight of the resulting copolymer (A-28) was $7.5 \times 10^3$.

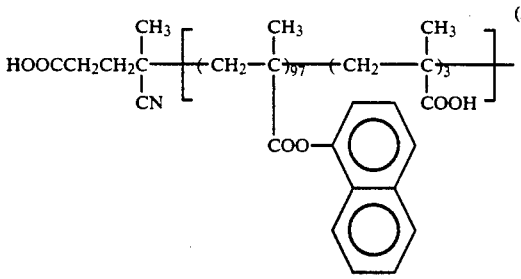

(A-28)

SYNTHESIS EXAMPLE 29 OF RESIN (A): (A-29)

A mixed solution of 97 g of benzyl methacrylate, 3 g of vinylbenzenecarboxylic acid, 1.5 g of thiosalicylic acid, and 200 g of toluene was heated to 75° C. under a nitrogen gas stream. Then, after adding 3.0 of A.C.V. to the resulting mixture, the reaction was carried out for 6 hours and, after further adding thereto 0.4 g of A.I.B.N., the reaction was carried out for 3 hours. An $\overline{M}w$ of the resulting copolymer (A-29) was $5.8\times10^3$.

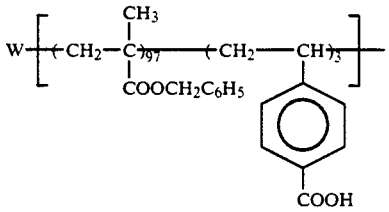

(A-29)

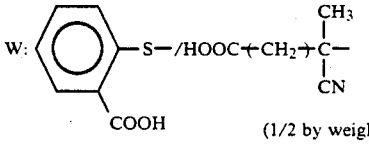

(1/2 by weight)

SYNTHESIS EXAMPLE 1 OF RESIN (B): (B-1)

A mixed solution of 100 g of ethyl methacrylate, 150 g of toluene, and 50 g of methanol was heated to 75° C. under a nitrogen gas stream. After adding 0.8 g of A.C.V. to the resulting mixture, the reaction was carried out for 5 hours and, after further adding thereto 0.2 g of A.C.V., the reaction was carried out for 4 hours. An Mw of the resulting polymer (B-1) was $8\times10^4$.

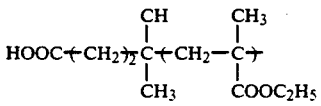

(B-1)

SYNTHESIS EXAMPLE 2 OF RESIN (B): (B-2)

A mixed solution of 85 g of methyl methacrylate, 15 g of methyl acrylate, 0.8 g of thioglycolic acid, and 200 g of toluene was heated to 75° C. under a nitrogen gas stream. Then, after adding 0.8 g of 1,1'-azobis(cyclohexane-1-carbonitrile) (abbreviated as A.B.C.C.) to the resulting mixture, the reaction was carried out for 5 hours and, after further adding thereto 0 2 g of A.B.C.C., the reaction was carried out for 4 hours. An $\overline{M}w$ of the resulting polymer (B-2) was $7.5\times10^4$.

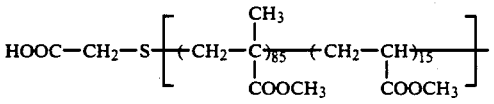

(B-2)

SYNTHESIS EXAMPLE 3 OF RESIN (B): (B-3)

A mixed solution of 73.5 g of methyl methacrylate, 15 g of methyl acrylate, 10 g of styrene, 1.5 g of acrylic acid, and 200 g of toluene was heated to 75° C. under a nitrogen gas stream. Then, after adding 1.0 g of 2,2'-azobis(isobutyronitrile) (abbreviated as A.I.B.N.) to the resulting mixture, the reaction was carried out for 4 hours and, after further adding thereto 0.6 g of A.I.B.N., the reaction was carried out for 4 hours.

An Mw of the resulting polymer (B-3) was $5.0\times10^4$.

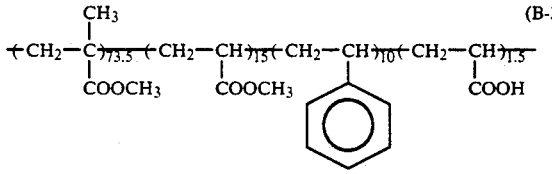

(B-3)

EXAMPLE 1

A mixture of 6 g (solid basis, hereinafter the same) of Resin (A-2), 34 g (solid basis, hereinafter the same) of Resin (B-1), 200 g of zinc oxide, 0.018 g of Cyanine Dye (I) shown below, and 300 g of toluene was dispersed in a ball mill for 4 hours to prepare a coating composition for a light-sensitive layer. The coating composition was coated on paper, which had been subjected to electrically conductive treatment, by a wire bar to a dry coverage of 25 g/m$^2$, followed by drying at 110° C. for 30 seconds. The coated material was allowed to stand in a dark place at 20° C. and 65% RH (relative humidity) for 24 hours to prepare an electrophotographic light-sensitive material.

Cyanine Dye (I):

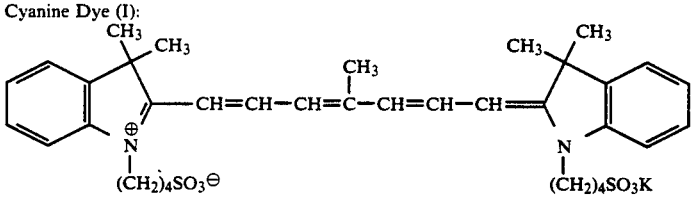

EXAMPLE 2

An electrophotographic light-sensitive material was prepared in the same manner as described in Example 1, except for using 6 g of Resin (A-1) in place of 6 g of Resin (A-2).

COMPARATIVE EXAMPLE A

An electrophotographic light-sensitive material was prepared in the same manner as described in Example 1 except that 6 g of Resin (R-1) having the following formula was used as a binder resin in place of 6 g of Resin (A-2).

Resin (R-1):

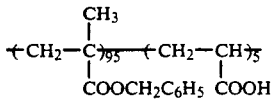

Mw: $6.3 \times 10^3$ (weight ratio)

COMPARATIVE EXAMPLE B

An electrophotographic light-sensitive material was prepared in the same manner as described in Example 1 except that 6 g of Resin (R-2) having the following formula was used as a binder resin in place of 6 g of Resin (A-2).

Comparative Resin (R-2)

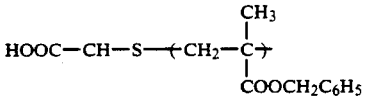

$\overline{M}w$: $6.3 \times 10^3$

COMPARATIVE EXAMPLE C

An electrophotographic light-sensitive material was prepared in the same manner as described in Example 1 except that 40 g of Resin (R-3) having the following formula was used as a binder resin in place of resin (A-2) and Resin (B-1).

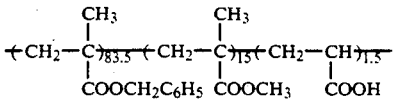

$\overline{M}w$: $4.8 \times 10^4$

On each of the light-sensitive materials thus obtained, the film property (surface smoothness), the charging property (occurrence of uneven charging), and the pre-exposure fatigue resistance were determined.

Furthermore, the printing property (background stains and printing durability) were determined when each of the light-sensitive materials was used as an offset printing master plate.

The results obtained are shown in Table 3.

TABLE 3

| | Example 1 | Example 2 | Comparative Example A | Comparative Example B | Comparative Example C |
|---|---|---|---|---|---|
| Smoothness of Photo-conductive Layer*1 (sec/cc) | 200 | 205 | 200 | 210 | 200 |
| Charging Property*2 (Uneven Charging) | None | None | occurred | slightly occurred | markedly occurred |
| Pre-Exposure Fatigue Resistance*3 | | | | | |
| $V_{10}$ Recovery Ratio (%) | 90% | 98% | 75% | 80% | 40% |
| Image-Formaing Performance | Good | Very Good | Dm lowered. Background fog formed. Fine lines cut. | Dm lowered. Background fog formed. | Dm markedly lowered. Background fog formed significantly. |
| Printing Property*4 | | | | | |
| Background stains of Light-sensitive Material | None | None | None | None | Background stains occurred markedly |
| Printing Durability | 10,000 prints or more | 10,000 prints or more | Background stain occurred from the first print. | Background stain occurred from the first print. | Background stain occurred from the first print. |

The evaluations described in Table 3 above were conducted as follows.

*1) Smoothness of Photoconductive Layer:

The smoothness (sec/cc) of light-sensitive material was measured using a Beck's smoothness test machine (manufactured by Kumagaya Riko K.K.) under an air volume condition of 1 cc.

*2) Charging Property:

Each of the light-sensitive materials was allowed to stand one day under the condition of 20° C. and 65% RH. Then, after modifying parameter of a full automatic plate making machine (ELP-404V manufactured by Fuji Photo Film Co., Ltd.) to forced conditions of charging potential of −4.5 kV and a charging speed of 20 cm/sec, each printing plate was prepared using a solid black image as an original and ELP-T (manufactured by Fuji Photo Film Co., Ltd.) as a toner, and the solid black image obtained (presence or absence of unevenness of charging, and the density in the solid black portion) was visually evaluated.

*3) Pre-Exposure Fatigue Resistance:

$V_{10}$ Recovery Ratio: After applying a corona discharge to each of the light-sensitive materials in the dark at 20° C. and 65% RH using a paper analyzer (Paper Analyzer Type SP-428, manufactured by Kawaguchi Denki K.K.) for 20 seconds at −6 kV, the light-sensitive material was allowed to stand for 10 seconds, and the surface potential $V_{10}A$ at the point of time was measured.

On the other hand, after exposing each of the light-sensitive materials to a fluorescent lamp for 20 seconds at a distance of 2 meters (500 lux), the light-sensitive material was allowed to stand in the dark for 10 seconds, and the surface potential $V_{10}B$ was measured in the same manner as $V_{10}A$ above. The $V_{10}$ recovery ratio was calculated by the equation $(V_{10}B/V_{10}A)\times 100(\%)$.

Image-Forming Performance

The light-sensitive material was allowed to stand one day in the dark at 20° C., 65% RH. Then, the light-sensitive material subjected to the above described pre-exposure was charged to −5 kV, irradiated by scanning with a gallium-aluminum-arsenic semiconductor laser (oscillation wavelength: 780 nm) of 2.8 mW output as a light source in an exposure amount on the surface of 50 erg/cm$^2$, at a pitch of 25 μm and a scanning speed of 330 meters/sec., and then developed using ELP-T (made by Fuji Photo Film Co., Ltd.) as a liquid developer followed by fixing. The duplicated image thus formed was visually evaluated for fog and image quality.

*4) Printing Property:

Background Stains of Light-Sensitive Material:

After subjecting the photoconductive layer surface of the light-sensitive material to an oil-desensitizing treatment by passing once the light-sensitive material through an etching processor using a solution obtained by diluting twice an oil-desensitizing solution ELP-EX made by Fuji Photo Film Co., Ltd.), the light-sensitive material was mounted on an offset printing machine (Oliver Type 52, manufactured by Sakurai Seisakusho K.K.) as an offset master plate for printing, and the extent of background stains formed on prints was visually evaluated.

Printing Durability:

A printing plate was made from each light-sensitive material under the same condition as described above for the image-forming performance for testing pre-exposure fatigue resistance. Then, the photoconductive layer of the master plate was subjected to an oil-desensitizing treatment by passing twice the master plate through the etching processor using the oil-desensitizing solution EPL-EX. The plate was mounted on the offset printing machine in the same manner as described above as an offset master plate for printing, and the number of prints obtained without forming background stains on the non-image portions of the prints and without causing problems on the image quality of the image portions was determined (the larger the number of the prints, the better the printing property).

As shown in Table 3, each of the electrophotographic light-sensitive materials according to the present invention had the photoconductive layer having a good smoothness. Also, at charging, uniform charging property was obtained without causing uneven charging. Also, under the condition of the light-sensitive material which had been pre-exposed prior to making a printing plate, the recovery was very good and the characteristics were almost the same as those under no light exposure. The actually duplicated images had no background fog and the duplicated image quality was clear. This is assumed to be based on that the photoconductive substance, the spectral sensitizer and the binder resin are absorbed each other in an optimum state and the absorbed state is stably maintained.

Also, when the light-sensitive material is subjected to an oil-desensitizing treatment with an oil-desensitizing solution and the contact angle between the surface after the treatment and a water drop is measured, the contact angle is as small as 10 degree or below, which shows that the surface is sufficiently rendered hydrophilic. When printing was actually conducted, the background stain of the prints was not observed.

Furthermore, when a printing plate precursor was prepared and used, each plate had good charging property and pre-exposed fatigue resistance, and duplicated image formed was clear and had no background fog. Thus, the oil-desensitization with an oil-desensitizing solution sufficiently proceeded and, after printing 10,000 prints, the prints had no background stains and showed clear image quality.

As shown in Example 2, when the electrophotographic light-sensitive material of the present invention contained the resin (A') having the methacrylate component having the specific substituent, the charging property and the pre-exposure fatigue resistance were further improved.

On the other hand, in Comparative Examples A and B using a known weight resin, uneven charging occurred under the severe condition. Also, the pre-exposure fatigue was large which influenced on the actual image forming performance to deteriorate the duplicated image (occurrence of background fog, cutting of fine lines and letters, lowering of density, etc.) Also, when the oil-desensitization by an oil-desensitizing solution was conducted, it was confirmed that the light-sensitive materials in the comparative examples showed no background stains on the prints, and the surface of the photoconductive layer was sufficiently rendered hydrophilic. However, when the printing plate prepared from the light-sensitive material was subjected to an oil-desensitizing treatment and used for printing as an offset master plate, prints showed background stains on the non-image portions from the first print and the image quality of the imaged portions was deteriorated (cutting of fine lines and letters, lowering of density, etc.). This shows that the reduction of the image quality of the master plate obtained by making printing plate appears on the prints as it is without being compensated by the oil-desensitizing treatment and, hence, the plate cannot be practically used.

Also, in Comparative Example C using the conventionally known intermediate molecular weight resin, all the characteristics were inferior to the case of Comparative Examples A and B.

Thus, it can be seen that only the light-sensitive materials according to the present invention are excellent in all the points of the smoothness of the photoconductive layer, electrostatic characteristics, and printing property.

EXAMPLES 3 TO 12

By following the same procedure as Example 1 except that 6 g of each of Resins (A) and 34 g of each of Resins (B) shown in Table 4 were used in place of the Resin (A-2) and the Resin (B-1), each of the electrophotographic light-sensitive materials shown in Table 4 was produced.

TABLE 4

| Example | Resin (A) | Resin (B) | Resin (B) (weight ratio) | Mw of Resin (B) |
|---|---|---|---|---|
| 3 | A-4 | B-4 | Poly(ethyl methacrylate) | $3.4 \times 10^5$ |
| 4 | A-5 | B-5 | $HOOC\text{-}(CH_2)_2\text{-}S\text{-}(CH_2\text{-}C(CH_3)(COOC_2H_5))\text{-}$ | $7 \times 10^4$ |
| 5 | A-7 | B-6 | $HOOC\text{-}(CH_2)_2\text{-}C(CH_3)_2\text{-}(CH_2\text{-}C(CH_3)(COOCH_2C_6H_5))\text{-}$ | $7.8 \times 10^4$ |
| 6 | A-8 | B-7 | $HOOC(CH_2)_2COO(CH_2)_2\text{-}C(CH_3)_2\text{-}(CH_2\text{-}C(CH_3)(COOC_2H_5))\text{-}$ | $8.5 \times 10^4$ |
| 7 | A-9 | B-8 | $\text{-}(CH_2\text{-}C(CH_3)(COOC_2H_5))_{99.5}\text{-}(CH_2\text{-}CH(COOH))_{0.5}$ | $6.3 \times 10^4$ |
| 8 | A-10 | B-9 | $\text{-}(CH_2\text{-}C(CH_3)(COOCH_3))_{78.5}\text{-}(CH_2\text{-}CH(COOCH_3))_{20}\text{-}(CH_2\text{-}CH(COOH))_{1.5}$ | $4.5 \times 10^4$ |
| 9 | A-12 | B-10 | $HO(CH_2)_2C(CH_3)_2\text{-}[(CH_2\text{-}C(CH_3)(COOC_3H_7))_{99.6}\text{-}(CH_2\text{-}C(CH_3)(COOCH_3))_{0.4}]$ | $9 \times 10^4$ |
| 10 | A-13 | B-11 | $\text{-}(CH_2\text{-}C(CH_3)(COOCH_3))_{87.5}\text{-}(CH_2\text{-}CH(COOC_2H_5))_{10}\text{-}(CH_2\text{-}C(CH_3)(COOH(CH_2)_2OCO(CH_2)_2COOH))_{2.5}$ | $5.3 \times 10^4$ |
| 11 | A-17 | B-12 | 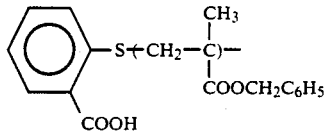 | $6.8 \times 10^4$ |
| 12 | A-22 | B-13 | $\text{-}(CH_2\text{-}C(CH_3)(COOC_2H_5))_{88}\text{-}(CH_2\text{-}C(CH_3)(COO(CH_2)_2OH))_{10}\text{-}(CH_2\text{-}CH(COO(CH_2)_2COOH))_2$ | $6.5 \times 10^4$ |

As shown in the above table, the light-sensitive materials of the present invention are excellent in the charging property, dark charge retention, and photosensitivity, and the practical duplicated images were clear and had no background fog even under the high-temperature and high-humidity condition (30° C., 80% RH) or the pre-exposure fatigue condition.

Furthermore, when each of the light-sensitive materials was used for printing as an offset printing plate, more than 10,000 prints having no background stains and having clear image quality were obtained.

EXAMPLES 13 TO 24

By following the same procedure as Example 1 except that 6.5 g of each of the Resins (A) and 33.5 g of each of the Resins (B) shown in Table 5 below were used as the binder resin and 0.018 g of Dye (II) shown below was used in place of 0.018 g of Cyanine Dye (I), each of the electrophotographic light-sensitive materials was prepared.

Dye (II):

-continued
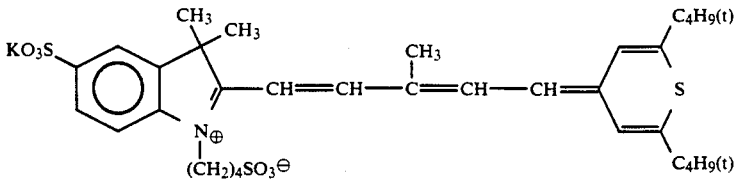
TABLE 5
| Example | Resin (A) | Resin (B) | Resin (B) (weight ratio) | Mw of Resin (B) |
|---|---|---|---|---|
| 13 | A-11 | B-14 | 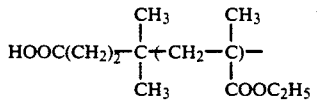 | $8 \times 10^4$ |
| 14 | A-14 | B-15 | 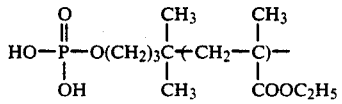 | $9 \times 10^4$ |
| 15 | A-15 | B-16 | 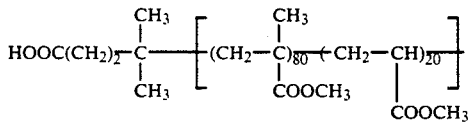 | $7.8 \times 10^4$ |
| 16 | A-19 | B-17 | 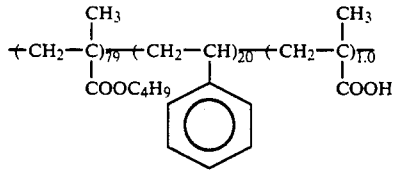 | $4.3 \times 10^4$ |
| 17 | A-20 | B-18 | 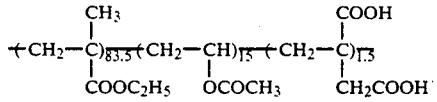 | $3.8 \times 10^4$ |
| 18 | A-21 | B-19 | 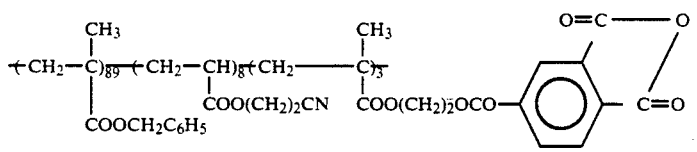 | $5 \times 10^4$ |
| 19 | A-23 | B-20 | 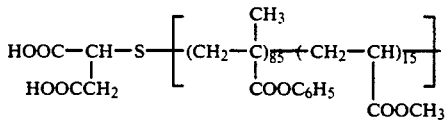 | $4 \times 10^4$ |
| 20 | A-24 | B-21 | 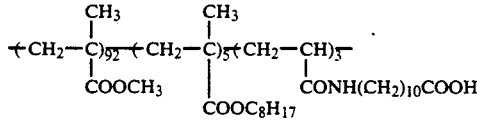 | $4.5 \times 10^4$ |
| 21 | A-25 | B-22 | 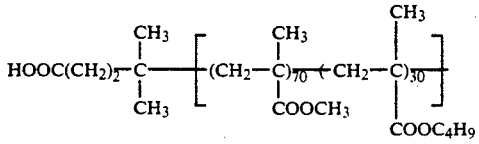 | $8 \times 10^4$ |

TABLE 5-continued

| Example | Resin (A) | Resin (B) | Resin (B) (weight ratio) | Mw of Resin (B) |
|---|---|---|---|---|
| 22 | A-26 | B-23 | 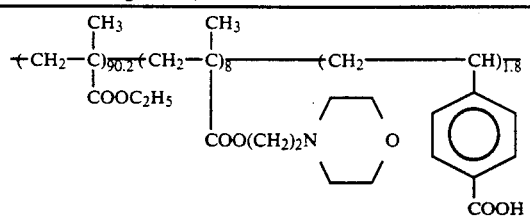 | $5.3 \times 10^4$ |
| 23 | A-27 | B-24 | 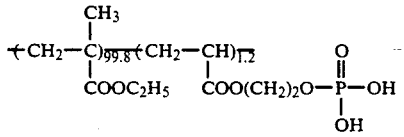 | $6 \times 10^4$ |
| 24 | A-1 | B-25 | 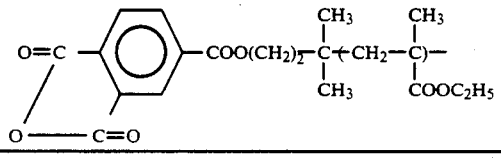 | $9 \times 10^4$ |

Each of the electrophotographic light-sensitive material of the present invention had excellent charging property and pre-exposure fatigue resistance, and, at actual duplication under severe conditions, clear images having no occurrence of background fog and cutting of fine lines were obtained. Furthermore, when printing was conducted using the light-sensitive material as an offset printing master plate, more than 10,000 prints having no background stains in non-image portions and having clear images could be obtained.

EXAMPLE 25

A mixture of 6.5 g (as solid component) of Resin (A-1), 33.5 g (as solid component) of Resin (B-9), 200 g of zinc oxide, 0.03 g of uranine, 0.075 g of Rose Bengale, 0.045 g of bromophenol blue, 0.1 g of phthalic anhydride, and 240 g of toluene was dispersed in a ball mill for 4 hours to prepare a coating composition for a photoconductive layer. The composition was coated on a paper subjected to a conductive treatment with a wire bar at a dry coverage of 20 g/m$^2$ followed by heating to 110° C. for 30 seconds and then allowed to stand in the dark for 24 hours at 20° C., 65% RH to obtain an electrophotographic light-sensitive material.

COMPARATIVE EXAMPLE D

By following the same procedure as Example 25 except that 6.5 g of Resin (R-1) used in Comparative Example A described above was used in place of 6.5 g of Resin (A-1), an electrophotographic light-sensitive material was produced.

COMPARATIVE EXAMPLE E

By following the same procedure as Example 25 except that 6.5 g of Resin (R-2) used in Comparative Example B described above was used in place of 6.5 g of Resin (A-1), an electrophotographic light-sensitive material was produced.

COMPARATIVE EXAMPLE F

By following the same procedure as Example 25 except that 40 g of Resin (R-3) used in Comparative Example C described above was used in place of Resin (A-1) and Resin (B-9) as the binder resin, an electrophotographic light-sensitive material was produced.

On each of the light-sensitive materials, the film property (surface smoothness), the charging property (occurrence of uneven charging), and the pre-exposure fatigue resistance were determined. Furthermore, each of the light-sensitive materials was used as an offset printing master plate, and the printing property (background stains, printing durability) of the resulting plate was determined.

The results are shown in Table 6.

TABLE 6

| | Example 25 | Comparative Example D | Comparative Example E | Comparative Example F |
|---|---|---|---|---|
| Smoothness of Photoconductive Layer (sec/cc) | 200 | 210 | 205 | 200 |
| Charging Property (Uneven Charging) | None | occurred | slightly occurred | markedly occurred |
| Pre-Exposure Fatigue Resistance | | | | |
| $V_{10}$ Recovery Ratio % | 95% | 73% | 81% | 50% |
| Image-Forming Performance[5] | Good | Dm lowered. Fogged. Cutting of fine lines occurred. | Dm lowered. Fogged. | Dm markedly lowered. Markedly fogged. |
| Printing Property | | | | |

TABLE 6-continued

| | Example 25 | Comparative Example D | Comparative Example E | Comparative Example F |
|---|---|---|---|---|
| Background Stains of Light-sensitive Material | None | None | None | Background stains generated significantly. |
| Printing Durability[6] | 10,000 prints or more | Background stains occurred from the first print. | Background stains occurred from the first print. | Background stains occurred from the first print. |

The image forming performance and the printing durability in Table 6 were evaluated as follows. The other evaluations were the same as described in Example 1.

*5) Image Forming Performance After Pre-exposure:

Each of the light-sensitive materials was allowed to stand one day in the dark at 20° C., 65% RH. Then, after operating under the pre-exposure condition described in *3), the light-sensitive material was processed using ELP-404V and ELP-T (toner) to make a printing plate precursor, and the duplicated image obtained was visually evaluated.

*6) Printing Durability:

A printing plate was prepared from each of the light-sensitive material under the same conditions as described in the image forming performance of *5). Then, the plate was subjected to the oil-desensitizing treatment, and printing was conducted in the same manner as in the printing durability of *4) described above and the resulting prints were evaluated.

The electrophotographic light-sensitive material of the present invention had a sufficient smoothness of the photoconductive layer, caused no uneven charging, and, also, when pre-exposure was applied, it recovered very quickly. Also, the duplicated images having no background fog stably obtained. Also, when the light-sensitive material was used as an offset printing plate, the non-image portions were sufficiently rendered hydrophilic and after printing 10,000 prints, further prints having no background stains and having clear image were obtained.

On the other hand, in Comparative Examples D and E using the known low-molecular weight resin, the charging property and the pre-exposure fatigue resistance were lowered and, in actually duplicated images, background fog, lowering of density, cutting of fine lines and letters were observed. Also, when each light-sensitive material was used as an offset master plate, stains occurred on the prints, and the image quality of the prints was lowered. Thus, they could not be practically used. Further, the sample of Comparative Example F was found to be more inferior to the sample of Comparative Example D.

Thus, it can be seen that the electrophotographic light-sensitive material having sufficient electrostatic characteristics and printing suitability was obtained only in the case of using the binder resin according to the present invention.

EXAMPLES 26 TO 34

By following the same procedure as Example 25 except that 6.0 g (as solid component) of each of the Resins (A) and 34.0 g of each of the Resins (B) shown in Table 7 were used in place of Resin (A-1) and Resin (B-9), each of the electrophotographic light-sensitive materials was produced.

TABLE 7

| Example | Resin (A) | Resin (B) | Resin (B) (weight ratio) | Mw of Resin (B) |
|---|---|---|---|---|
| 26 | A-2 | B-26 | 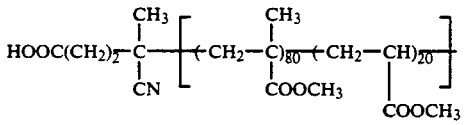 | $7.5 \times 10^4$ |
| 27 | A-3 | B-27 | 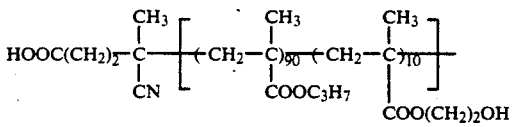 | $8 \times 10^4$ |
| 28 | A-4 | B-28 | 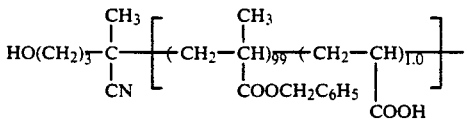 | $5.3 \times 10^4$ |

TABLE 7-continued

| Example | Resin (A) | Resin (B) | Resin (B) (weight ratio) | Mw of Resin (B) |
|---|---|---|---|---|
| 29 | A-6 | B-29 | 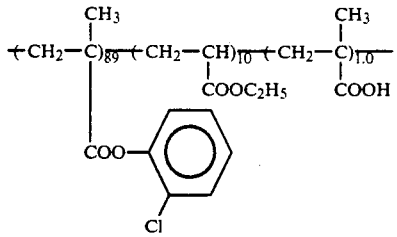 | $4.5 \times 10^4$ |
| 30 | A-15 | B-30 | 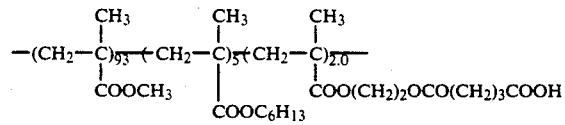 | $4.8 \times 10^4$ |
| 31 | A-16 | B-31 | 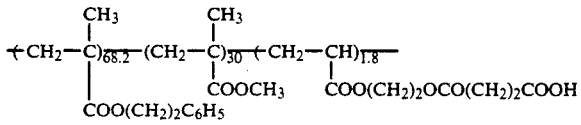 | $6.5 \times 10^4$ |
| 32 | A-22 | B-32 | 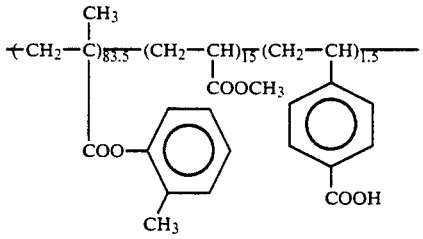 | $5 \times 10^4$ |
| 33 | A-25 | B-33 | 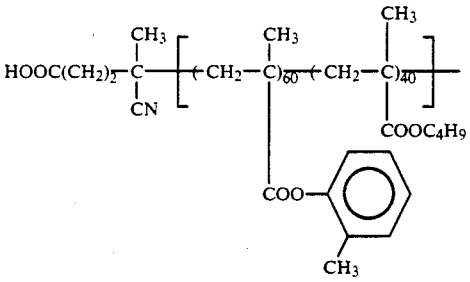 | $9 \times 10^4$ |
| 34 | A-26 | B-34 | 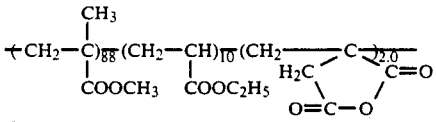 | $6 \times 10^4$ |

The electrostatic characteristics of each of the light-sensitive materials were determined in the same manner as in Example 25. The results showed that each light-sensitive material was excellent in charging property and pre-exposure fatigue resistance, and at the formation of the duplicated images under severe conditions, clear images having neither background fog nor cutting of fine lines were obtained.

Furthermore, when printing was conducted using the light-sensitive material as an offset printing master plate after making printing plate, more than 10,000 prints having no background stains at the non-image portions and having clear image could be obtained.

EXAMPLE 35

A mixture of 6.5 g of Resin (A-30) shown below, 33.5 g of Resin (B-28) shown above, 200 g of zinc oxide, 0.03 g of uranine, 0.040 g of a methine dye shown below, 0.040 g of bromophenol blue, 0.15 g of salicylic acid, and 240 g of toluene was dispersed in a ball mill for 4 hours, then 0.5 g of glutaric anhydride was added thereto and dispersed further for 10 minutes to prepare a coating composition for photoconductive layer.

The composition was coated on a paper, which had been subjected to a conductive treatment, with a wire bar at a dry coverage of 22 g/m$^2$ followed by heating to 110° C. for 15 seconds and, after further heating to 140° C. for 2 hours, allowed to stand for 24 hours in the dark at 20° C., 65% RH to obtain an electrophotographic light-sensitive material.

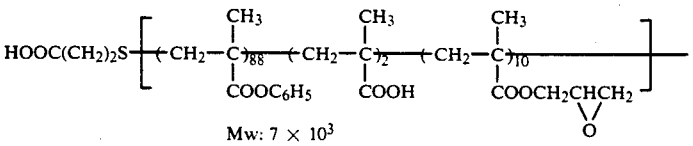

(A-30)

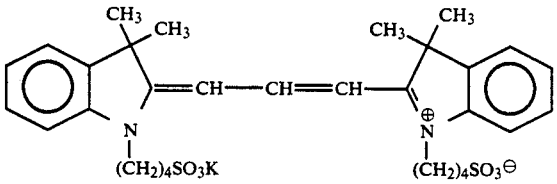

Methine Dye

The characteristics of the light-sensitive material were determined in the same manners as in Example 25.

The smoothness of the photoconductive layer was 225 (sec/cc) and the charging property was uniform and good. The pre-exposure fatigue resistance was $V_{10}$ recovery ratio of 93% and the image forming performance was good. Also, when it was used as an offset printing mater plate after making printing plate, no background stains were observed in the light-sensitive material. When printing was conducted, more than 10,000 prints having no background stains and having clear images were obtained.

EXAMPLES 36 TO 39

By following the same procedure as Example 35 except that each of the compounds shown in Table 8 was used in place of 6.5 g of Resin (A-30) and 0.5 g of glutaric anhydride as crosslinking agent and also 33 g of Resin (B-29) was used in place of Resin (B-28), each of the electrophotographic light-sensitive materials was produced.

TABLE 8

| Example | Resin (A) | Resin (A) (weight ratio) and Mw | Crosslinking Agent and Amount thereof |
|---|---|---|---|
| 36 | (A-31) | 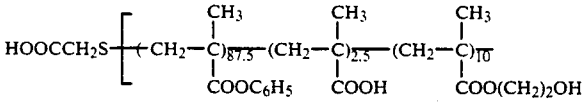  $\overline{M}w$ 7 × 10³ | 1,6-Hexanediisocyanate 1 g |
| 37 | (A-32) | 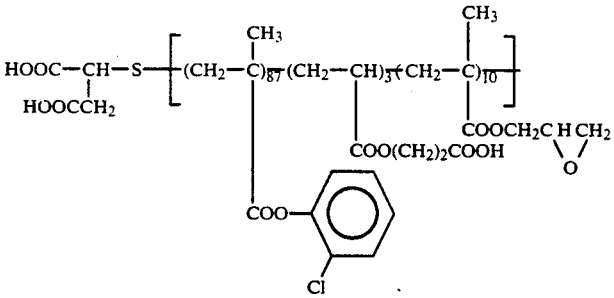  $\overline{M}w$ 6 × 10³ | 3-(N,N-dimethylamino)-propylamine 0.8 g |
| 38 | (A-33) | 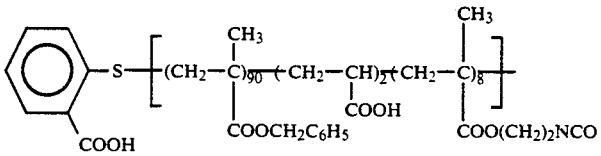  $\overline{M}w$ 6.8 × 10³ | 1,6-Butanediol 0.8 g |

TABLE 8-continued

| Example | Resin (A) | Resin (A) (weight ratio) and Mw | Crosslinking Agent and Amount thereof |
|---|---|---|---|
| 39 | (A-34) | 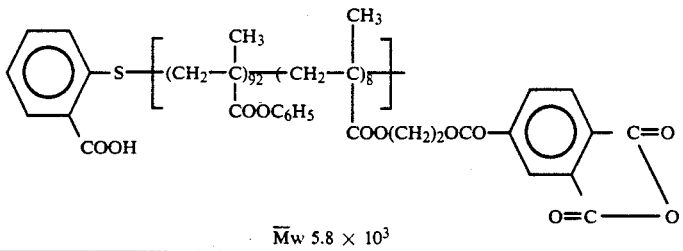 $\overline{M}w$ 5.8 × $10^3$ | Hexamethylenediamine 0.6 g |

In each light-sensitive material, the characteristics were determined as in Example 25.

Each light-sensitive material was good in the charging property and the pre-exposure fatigue resistance, and at the formation of the duplicated image under severe conditions, clear images having no occurrence of background fog and cutting of fine lines were obtained. Furthermore, when it was used as an offset master printing plate after making printing plate, more than 10,000 prints having no background fog at non-image portions and having clear images could be obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support having provided thereon a photoconductive layer containing at least an inorganic photoconductive substance, a spectral sensitizer, and a binder resin, wherein said binder resin contains (1) at least one binder resin (A) having a weight average molecular weight of from $1\times10^3$ to $1\times10^4$ which contains at least 30% by weight of a polymer component represented by formula (I) shown below and from 0.1 to 10% by weight of a polymer component containing at least one acidic group selected from $-PO_3H_2$, $-SO_3H$, —COOH,

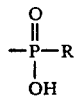

(wherein R represents a hydrocarbon group or —OR′ (wherein R′ represents a hydrocarbon group) and a cyclic acid anhydride-containing group, and which has at least one acidic group selected from the above-described acidic groups at one terminal of the main chain of the copolymer;

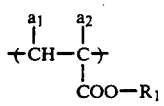

(I)

wherein $a_1$ and $a_2$ each represents a hydrogen atom, a halogen atom, a cyano group; or a hydrocarbon group, and $R_1$ represents a hydrocarbon group; and (2) at least one binder resin (B) having a weight average molecular weight of from $3\times10^4$ to $1\times10^6$ which contains at least 30% by weight of a polymer component represented by following formula (III);

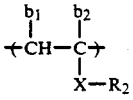

(III)

wherein X represents $(CH_2)_nCOO$—, $(CH_2)_mOCO$—, —O— or

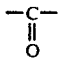

(wherein n and m each represents an integer of from 0 to 3); and $b_1$, $b_2$, and $R_2$ have the same meaning as $a_1$, $a_2$, and $R_1$, respectively, in formula (I).

2. The electrophotographic light-sensitive material as in claim 1, wherein said binder resin (A) contains at least one methacrylate component having an aryl group represented by following formulae (IIa) and (IIb) as the copolymer component represented by formula (I);

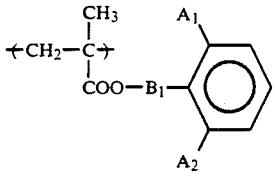

(IIa)

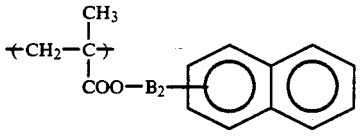

(IIb)

wherein $A_1$ and $A_2$ each represents a hydrogen atom, a hydrocarbon group having from 1 to 10 carbon atoms, a chlorine atom, a bromine atom, $—COD_1$ or $—COOD_2$ (wherein $D_1$ and $D_2$ each represents a hydrocarbon group having from 1 to 10 carbon atoms); $B_1$ and $B_2$ each represents a single bond or a linking group having from 1 to 4 linking atoms which bonds —COO— and the benzene ring.

3. The electrophotographic light-sensitive material as in claim 1, wherein said binder resin (B) is a random copolymer containing at least 30% by weight of said copolymer component represented by formula (III) and not more than 10% by weight of at least one copolymer component containing at least one acidic group selected from —COOH, $—PO_3H_2$, $—SO_3H$,

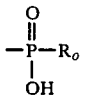

(wherein $R_o$ has the same meaning as R described above) and an acid anhydride-containing group.

4. The electrophotographic light-sensitive material as in claim 1, wherein said binder resin (B) has at least one acidic group selected from the acidic group selected from —COOH, $—PO_3H_2$, $—SO_3H$,

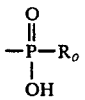

(wherein $R_o$ has the same meaning as R described above) and an acid anhydride-containing group at one terminal of the polymer main chain.

5. The electrophotographic light-sensitive material as in claim 1, wherein the ratio of the binder resin (A) to the binder resin (B) is from 5/95 to 60/40.

6. The electrophotographic light-sensitive material as in claim 1, wherein the total content of the acidic groups in the acidic group-containing copolymer component of resin (A) and the acidic group bonded to the terminal of the main chain in the resin (A) is from 1 to 20% by weight of resin (A).

7. The electrophotographic light-sensitive material as in claim 1, wherein the resin (A) further contains from 1 to 20% by weight of a copolymer component having a heat- and/or photo-curable functional group.

8. The electrophotographic light-sensitive material as in claim 1, wherein the resin (B) further contains from 0.1 to 20% by weight of a copolymer component having a heat- and/or photo-curable functional group.

9. The electrophotographic light-sensitive material as in claim 1, wherein the spectral sensitizer is a polymethine dye.

10. The electrophotographic light-sensitive material as in claim 9, wherein the polymethine dye is capable of spectrally sensitizing in the wavelength region of 700 nm or more.

11. The electrophotographic light-sensitive material as in claim 1, wherein the photoconductive layer further contains a chemical sensitizer.

* * * * *